US011145269B2

(12) United States Patent
Yabuki

(10) Patent No.: US 11,145,269 B2
(45) Date of Patent: Oct. 12, 2021

(54) DISPLAY APPARATUS ACCURATELY REDUCING DISPLAY NON-UNIFORMITY

(71) Applicant: SAKAI DISPLAY PRODUCTS CORPORATION, Sakai (JP)

(72) Inventor: Haruhito Yabuki, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/935,085

(22) Filed: Jul. 21, 2020

(65) Prior Publication Data

US 2021/0035518 A1 Feb. 4, 2021

Related U.S. Application Data

(60) Provisional application No. 62/881,941, filed on Aug. 2, 2019.

(51) Int. Cl.
*G09G 3/36* (2006.01)

(52) U.S. Cl.
CPC ..... *G09G 3/3688* (2013.01); *G09G 3/3677* (2013.01); *G09G 2310/08* (2013.01); *G09G 2320/0233* (2013.01); *G09G 2370/08* (2013.01)

(58) Field of Classification Search
CPC ..... G09G 3/36; G09G 3/3611; G09G 3/364; G09G 3/3644; G09G 3/3648; G09G 3/3674; G09G 3/3677; G09G 3/3681; G09G 3/3685; G09G 3/3688; G09G 2310/08
USPC ..... 345/87–104
See application file for complete search history.

(56) References Cited

U.S. PATENT DOCUMENTS

| | | | | |
|---|---|---|---|---|
| 10,978,011 | B2 * | 4/2021 | Yabuki | G09G 3/2092 |
| 2007/0152947 | A1 | 7/2007 | Tanaka et al. | |
| 2009/0002264 | A1 * | 1/2009 | Pai | G09G 3/3666 345/3.2 |
| 2009/0129524 | A1 * | 5/2009 | Chen | H03B 19/00 375/376 |
| 2011/0007065 | A1 | 1/2011 | Tanaka et al. | |
| 2012/0050146 | A1 | 3/2012 | Tanaka et al. | |
| 2013/0038582 | A1 * | 2/2013 | Yen | G09G 3/2096 345/204 |
| 2013/0120353 | A1 | 5/2013 | Tanaka et al. | |
| 2013/0222350 | A1 | 8/2013 | Tanaka et al. | |

(Continued)

FOREIGN PATENT DOCUMENTS

JP 4869706 B2 2/2012

*Primary Examiner* — Alexander Eisen
*Assistant Examiner* — Nelson Lam
(74) *Attorney, Agent, or Firm* — ScienBiziP, P.C.

(57) ABSTRACT

A display apparatus comprises: a display panel; a scanning line drive unit; a plurality of data line drive units to output a data line signal to target data lines; and a timing control unit. A first correction time is set individually for each data line drive unit and a second correction time is set individually for each target data line. The timing control unit transmits the image signal to each data line drive unit, with a delay by the first correction time from a transmission start time for a group of pixels lined up in a row direction based on a first clock signal, and each data line drive unit outputs the data line signal with a delay by the second correction time from an output reference time for target pixels being connected to the target data lines based on a second clock signal synchronized with the first clock signal.

15 Claims, 13 Drawing Sheets

(56) References Cited

U.S. PATENT DOCUMENTS

| | | | | |
|---|---|---|---|---|
| 2013/0321253 | A1* | 12/2013 | Park | G09G 3/3614 345/100 |
| 2014/0232713 | A1* | 8/2014 | Hsu | G09G 3/3685 345/213 |
| 2015/0049076 | A1* | 2/2015 | Kim | G09G 3/3685 345/212 |
| 2015/0145852 | A1* | 5/2015 | Ahn | G09G 3/3677 345/214 |
| 2015/0364099 | A1* | 12/2015 | Shibuya | G09G 3/3688 345/204 |
| 2016/0365042 | A1* | 12/2016 | Zheng | G09G 3/36 |
| 2017/0047016 | A1 | 2/2017 | Son et al. | |

* cited by examiner

DISPLAY APPARATUS ACCURATELY REDUCING DISPLAY NON-UNIFORMITY

CROSS-REFERENCE TO RELATED APPLICATIONS

This application claims priority to and the benefit of priority of U.S. Provisional Application No. 62/881,941, filed on Aug. 2, 2019 the entire contents of which are incorporated herein by reference.

BACKGROUND

Technical Field

The present disclosure relates to a display apparatus.

Description of Related Art

In a display apparatus comprising a display panel such as a liquid crystal display panel or an organic-EL display panel, a switching element, for example, a thin-film transistor (TFT), is primarily provided for each one of a plurality of pixels being arranged in a matrix. The display panel comprises a plurality of scanning lines being provided for each row of the plurality of pixels and a plurality of data lines being provided for each column thereof. A scanning line signal to be applied to a scanning line being connected to the gate of TFTs lined up in each row causes the signal level thereof to transition, in order, from a low level to a high level, causing the TFT to be turned on in accordance with the level transition thereof. On the other hand, each of the data lines is connected to the source (or the drain) of each one of the plurality of TFTs lined up in each column. A data line signal having the level (for example, the potential) according to the luminance that the pixel to be selected by the scanning line signal (the pixel comprising the TFT to be turned on) is to have is applied to each of the data lines.

For example, in the liquid crystal display panel, based on the potential of the data line signal applied to the TFT being turned on, a voltage is applied to a liquid crystal layer of the pixel comprising the that TFT. Then, a capacitance of the liquid crystal layer (and an auxiliary capacitance being provided in parallel with the liquid crystal layer) is charged or discharged with the voltage applied. Thus, even after the TFT is turned off, the voltage being applied to the liquid crystal layer is held over the display period of one still image (frame). Each pixel transmits light at the transmittance based on the voltage being held.

Moreover, in the organic-EL display panel, each pixel comprises a selecting TFT in which the gate and the source are connected to a scanning line and a data line, respectively, and a driving TFT being connected between the selecting TFT and an organic-EL element. A holding capacitance being connected between the source and the gate of the driving TFT is charged/discharged based on the potential of a data line signal being applied to the selecting TFT being turned on. The voltage that the holding capacitance has after being charged/discharged is held over the display period of one frame and the organic-EL element emits light with the luminance according to the drain current of the driving TFT based on the voltage.

Therefore, to obtain a desired luminance in each pixel of the display apparatus such as the liquid crystal display apparatus, it is required, in alignment with the timing of the level transition of the scanning line signal, to apply the potential, to the data line, according to the luminance that the pixel comprising the TFT to be turned on by the level transition is to have. However, each scanning line has resistive and capacitive components, so that, deforming (rounding) of the waveform of the scanning line signal easily occurs in conjunction with propagation on the scanning line. When the waveform of the scanning line signal changes on the scanning line, on and off timings of the TFT mutually differ between pixels being connected to one scanning line signal, causing display non-uniformity such as luminance non-uniformity and/or color non-uniformity to occur in conjunction with a variation in the charge state between the pixels.

SUMMARY

An object of the present disclosure is to provide a display apparatus that accurately reduces display non-uniformity by carrying out a correction with a wide range of correction amounts while suppressing complexification of the structure and an increase in manufacturing cost in a case of reducing display non-uniformity due to a propagation delay such as deforming of a waveform of a scanning line signal by correcting the timing of a level transition of a data line signal.

A display apparatus according to one embodiment of the present disclosure comprises: a display panel comprising a plurality of pixels being arranged in a matrix, a plurality of scanning lines being connected to a group of pixels being lined up in a row direction of the plurality of pixels, and a plurality of data lines being connected to a group of pixels being lined up in a column direction of the plurality of pixels; a scanning line drive unit to successively output a scanning line signal to the plurality of scanning lines, the scanning line signal to select the group of pixels being lined up in the row direction; a plurality of data line drive units, each being connected to two or more target data lines of the plurality of data lines, to output a data line signal to each of the two or more target data lines, wherein the data line signal supplies a desired voltage to two or more target pixels of a group of pixels being selected by the scanning line signal, the two or more target pixels being connected to the two or more target data lines; and a timing control unit to transmit an image signal to each one of the plurality of data line drive units and to control the operational timing of the scanning line drive unit and the plurality of data line drive units, the image signal being a signal to be the basis of the data line signal and comprising information on luminance that each pixel is to have. A first correction time is set individually for each one of the plurality of data line drive units, the first correction time indicating a delay amount when the image signal is transmitted; a second correction time is set individually for each of the two or more target data lines, the second correction time indicating a delay amount when the data line signal is output; the timing control unit transmits the image signal to each one of the plurality of data line drive units for each group of pixels being lined up in the row direction, while delaying the image signal by the first correction time being set for a relevant data line drive unit from a start time of transmission with respect to a relevant group of pixels being lined up in the row direction based on a first clock signal; and each one of the plurality of data line drive units outputs the data line signal to each of the two or more target data lines, while delaying the data line signal by the second correction time being set for a relevant target data line from an output reference time with respect to the two or more target pixels based on a second clock signal being synchronized with the first clock signal.

DETAILED DESCRIPTION

Below, with reference to the drawings, a display apparatus according to the present disclosure will be described. The display apparatus according to the present disclosure is construed to be not limited by the embodiments to be described below and the recitations of each drawing to be referred to.

[Overall Configuration]

Figure 1:
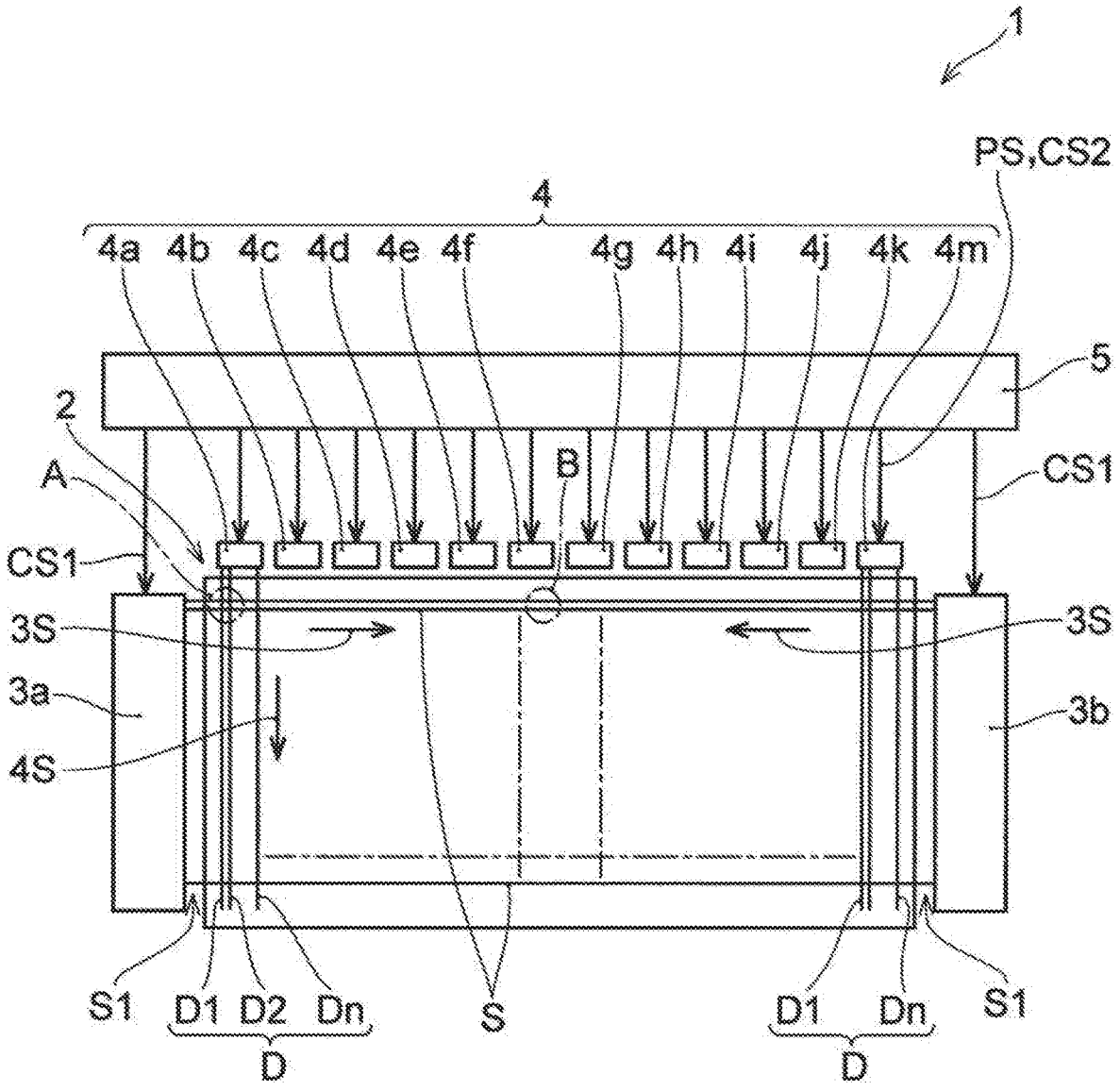
FIG. 1 schematically shows one example of the configuration of a display apparatus according to one embodiment of the present disclosure.
Figure 2:
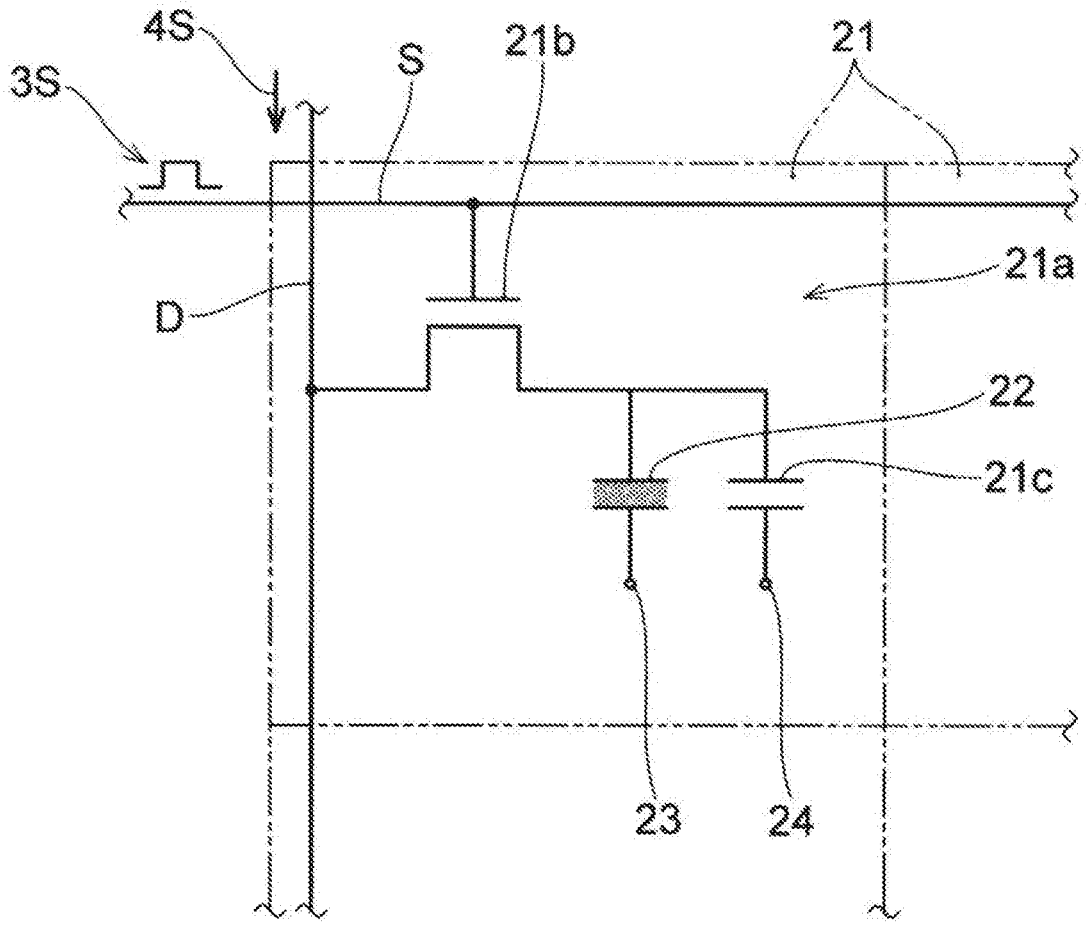
FIG. 2 is a circuit diagram showing one example of a pixel circuit of a display panel according to one embodiment of the present disclosure.

FIG. 1 schematically shows one example of the configuration of a display apparatus 1 according to one embodiment of the present disclosure. FIG. 2 shows a circuit diagram of one example of a pixel circuit 21*a* of a display panel 2 being provided for the display apparatus 1 according to one embodiment of the present disclosure. As shown in FIGS. 1 and 2, the display apparatus 1 comprises a display panel 2 comprising a plurality of pixels 21 being arranged in a matrix, scanning line drive units 3*a*, 3*b* to output a scanning line signal 3S to select a group of pixels being lined up in the row direction of the plurality of pixels 21, a plurality of data line drive units 4 being arrayed along the row direction of the plurality of pixels 21; and a timing control unit 5 to control the operational timing of the scanning line drive units 3*a*, 3*b* and the plurality of data line drive units 4. The display panel 2 further comprises a plurality of scanning lines S being connected to a group of pixels lined up in a row direction of the plurality of pixels 21, and a plurality of data lines D being connected to a group of pixels lined up in a column direction of the plurality of pixels 21.

Each one of the plurality of scanning lines S is connected to the scanning line drive units 3*a*, 3*b*, and each one of the plurality of data lines D is connected to any one of the plurality of data line drive units 4. The scanning line drive units 3*a*, 3*b* successively output the scanning line signal 3S to the plurality of scanning lines S. The scanning line signal 3S selects a group of pixels 21 being lined up in the row direction and connected to each of the scanning lines S. Each one of the plurality of data line drive units 4 is connected to two or more data lines (a set of data lines D1 to Dn in the example in FIG. 1) of the plurality of data lines D. The data line being connected to each of the data line drive units 4 is also called "a target data line" of the relevant data line drive unit 4. Each of the data line drive units 4 outputs a data line signal 4S to each of the respective target data lines. The data line signal 4S to be output to two or more target data lines of each of the data line drive units 4 supplies a desired voltage according to the luminance that each pixel is to have to two or more target pixels being connected to the two or more relevant target data lines among the pixels selected by the scanning signal 3S.

The timing control unit 5 generates an image signal PS being a signal to be the basis of the data line signal 4S and comprising information on the luminance that each pixel 21 is to have, and transmits the generated image signal PS to each one of the plurality of data line drive units 4. The timing control unit 5 generates a control signal CS1, CS2 to control display of image by the display panel 2, along with the image signal. PS. The control signal CS1 is output to the scanning line drive units 3*a*, 3*b* and the scanning line drive units 3*a*, 3*b* control an output operation of the scanning line signal 3S based on the control signal CS1. The control signal CS2 is output to the data line drive units 4 along with the image signal PS. The data line drive units 4 generate the data line signal 4S based on the image signal PS and the control signal CS2 and controls outputting of the data line signal 4S based on the control signal CS2.

"A scan period" of the display panel 2 is a period to be allocated to write pixel data into a group of pixels 21 being lined up in each row. For example, one scan period can correspond to one cycle of a scanning line clock signal indicating the output timing of the scanning line signal 3S. On the other hand, "a horizontal period" is a period in which the image signal PS being necessary to supply a desired voltage to all of the data lines D1 to Dn being connected to each of the data line drive units 4 is transmitted from the timing control unit 5 to each of the data line drive units 4. The horizontal period comprises a period in which the image signal PS is transmitted from the timing control unit 5 (which is also called "a display period" in the following) and a blank period in which the image signal PS is not transmitted. The blank period is a period in which the image signal PS is not received in each of the data line drive units 4. When each of the data line drive units 4 completes reception of the image signal PS with respect to their own target pixels in the display period in one horizontal period, the image signal PS of the following horizontal period is received after elapsing of a subsequent predetermined blank period. A control signal for the data line drive unit 4 or a dummy signal can be transmitted in the blank period.

In the example in FIG. 1, the scanning line drive unit 3*a* is arranged at one of the opposite ends in the row direction of the display panel 2, the scanning line drive unit 3*b* is arranged at the other one thereof, so that the two scanning line drive units are provided. The opposite ends of each one of the plurality of scanning lines S are connected to either one of the scanning line drive units 3*a* and 3*b*. The scanning line signal 3S output from each of the scanning line drive units 3*a* and 3*b* is input to either one end S1 of each of the scanning lines S. The scanning line drive unit can be arranged only at one end of the display panel 2 in the row direction. Moreover, while the scanning line drive units 3*a* and 3*b* are each depicted as one block at each of the opposite ends of the display panel 2 in FIG. 1, an arbitrary plurality of separately formed scanning line drive units 3 can be provided at opposite ends or one end of the display panel 2 in the row direction.

The scanning line drive units 3*a*, 3*b* are each configured with an amplifying circuit and a register circuit, for example. The scanning line drive units 3*a*, 3*b* can be integrated into one semiconductor integrated circuit device (IC), or a so-called scanning line driver IC can be used as the scanning line drive units 3*a*, 3*b*. In that case, for example, the scanning line driver IC can be connected to the display panel 2 via a flexible wiring board. The scanning line drive units 3*a*, 3*b* can be formed at the peripheral edge of the display panel 2.

In the example in FIG. 1, twelve of the data line drive units 4 (a data line drive unit 4*a*, 4*b*, . . . , 4*k*, 4*m* (except 4*l*) are provided along the row direction. The number of the data line drive units 4 in the plurality of data line drive units 4 is construed to be not limited to twelve, so that an arbitrary number of data line drive units 4, the arbitrary number being at least two, can be provided. In the explanations below, in a case that it is not necessary to specify any one of the plurality of data line drive units 4, an individual data line drive unit (for example, the data line drive unit 4*a*) is also merely called the data line drive unit 4.

Target data lines comprising a group of predetermined number of data lines from the data line D1 to the data line Dn are connected to each of the data line drive units 4. In each of the data line drive units 4*a* to 4*f*, the data line D1 and the data line Dn are a data line being proximate to the scanning line drive unit 3*a* and a data line being most distant from the scanning line drive unit 3*a*, respectively, of the target data lines of each data line drive unit, the scanning line drive unit 3*a* being closer to each data line drive unit of the scanning line drive units 3*a* and 3*b*. On the other hand, in each of the data line drive units 4*g* to 4*m*, the data line D1 and the data line Dn are a data line being most distant from the scanning line drive unit 3*b* and a data line being proximate to the scanning line drive unit 3*b*, respectively, of the target data lines of each data line drive unit, the scanning line drive unit 3*b* being closer to each data line drive unit of the scanning line drive units 3*a* and 3*b*.

As in one example to be described below, each one of the plurality of data line drive units 4 can be configured with a circuit to receive an image signal, a shift register, a line memory, a level shifter, and a digital-analog converter (D/A converter). Each of the data line drive units 4 can be integrated into one semiconductor integrated circuit device (IC), or a so-called source driver IC or data line driver IC can be used as the data line drive unit 4. In that case, for example, the source driver IC can be connected to the display panel 2 via a flexible wiring board.

The timing control unit 5 is realized as a module substrate (Tcon substrate) comprising a wiring board and a main component such as an application specific IC (ASIC) or a dedicated IC being mounted on the surface of the wiring board and a peripheral component of the main component. An image processing circuit, a line memory, a timing generating circuit, and an output buffer to be described below as constituting elements of the timing control unit 5 can also be realized using an internal circuit such as the ASIC or the dedicated IC. In the timing control unit 5, the image signal PS and each control signal CS1, CS2 are timely generated and transmitted to the scanning line drive units 3*a*, 3*b*, or the data line drive units 4. The timing control unit 5 is electrically connected to each of the data line drive units 4 and each of the scanning line drive units 3*a* and 3*b* via a flexible wiring board, for example.

The display panel 2 can comprise the plurality of scanning lines S and the plurality of data lines D, the number of the plurality of scanning lines S and the plurality of data lines D being arbitrary. For example, 1920×3 (=5760) data lines D are provided in the full-high definition (PHD) display panel. 11520 and 23040 data lines D are provided in a so-called 4K display panel and a so-called 8K display panel, respectively, which have the resolution being four times and 16 times the PHD, respectively. Moreover, 1080, 2160, or 4320 scanning lines S can be provided.

While the display panel 2 is construed to be not limited in particular as long as it is a display panel comprising pixels being arranged in a matrix, the liquid crystal display panel or an organic-EL display panel is exemplified as the display panel 2 of the display apparatus 1. FIGS. 1 and 2 show an example in which the display apparatus 1 is a liquid crystal display apparatus. Thus, a liquid crystal layer 22 is shown along with a pixel circuit 21*a*. In the explanations below, the display apparatus 1 according to the present embodiment is explained assuming that the display panel 2 is a liquid crystal display panel.

As shown in FIG. 2, the pixel circuit 21*a* is provided for each one of the plurality of pixels 21. The pixel circuit 21*a* comprises a TFT 21*b* and an auxiliary capacitance 21*c*. The gate of the TFT 21*b* is connected to the scanning line S. One of the source and the drain of the TFT 21*b* is connected to the data line D, while the other is connected to the auxiliary capacitance 21*c* and also connected to the liquid crystal layer 22. The liquid crystal layer 22 is sandwiched between a pixel electrode and an opposing electrode (not shown), and the pixel electrode is connected to the TFT 21*b* and the opposing electrode is connected to a common electrode 23, respectively. An electrode of the auxiliary capacitance 21*c*, the electrode being opposite to the TFT 21*b*, is connected to a capacitance electrode 24.

When the level of the scanning line signal 3S to be applied to the scanning line S transitions to the level being at least the gate threshold value of the TFT 21*b*, for example, the TFT 21*b* is turned on, and the liquid crystal layer 22 and the auxiliary capacitance 21*c* is charged or discharged based on the level (potential) of the data line signal 4S. Then, preferably, during the time period within which the TFT 21*b* is being turned on, the pixel electrode of the liquid crystal layer 22 reaches the same potential as that of the data line signal 4S. While the TFT 21*b* transitions to an off state when the level of the scanning line signal 3S transitions to less than the gate threshold value of the TFT 21*b*, the potential difference between electrodes sandwiching the liquid crystal layer 22 is generally maintained by the capacitive component such as the auxiliary capacitance 21*c*. As a result, in each one of the plurality of pixels 21, the liquid crystal layer 22 transmits light with the transmittance based on the level of the data line signal 4S at the time when the TFT 21*b* is turned on, causing a desired image to be displayed on the display panel 2.

Figure 3A:
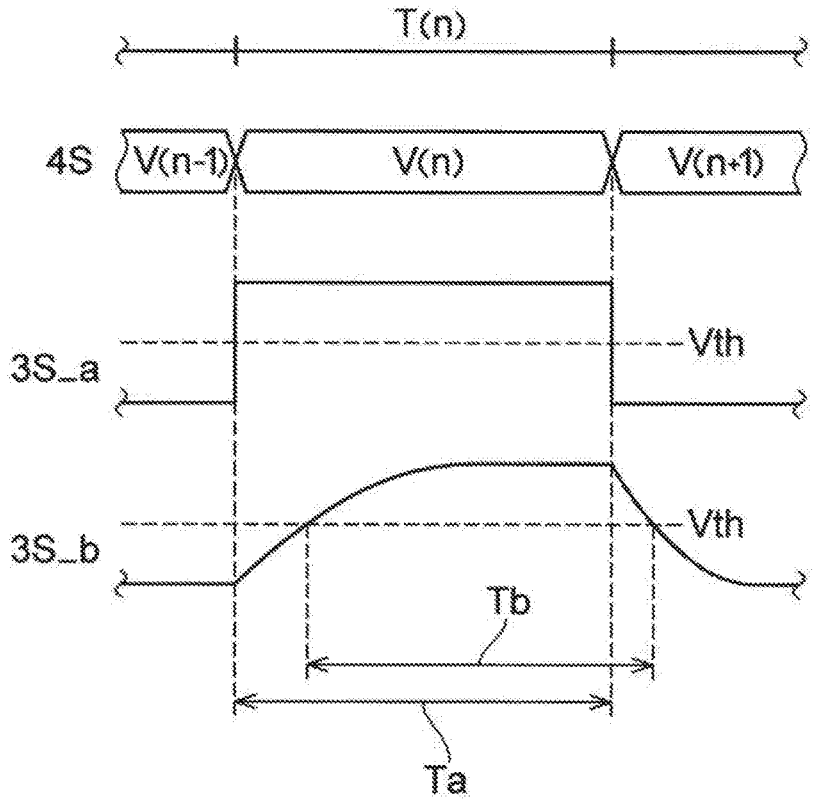
FIG. 3A is a timing chart showing a delay of a selection period of a pixel that can occur due to deforming of a waveform of a scanning line signal.
Figure 3B:
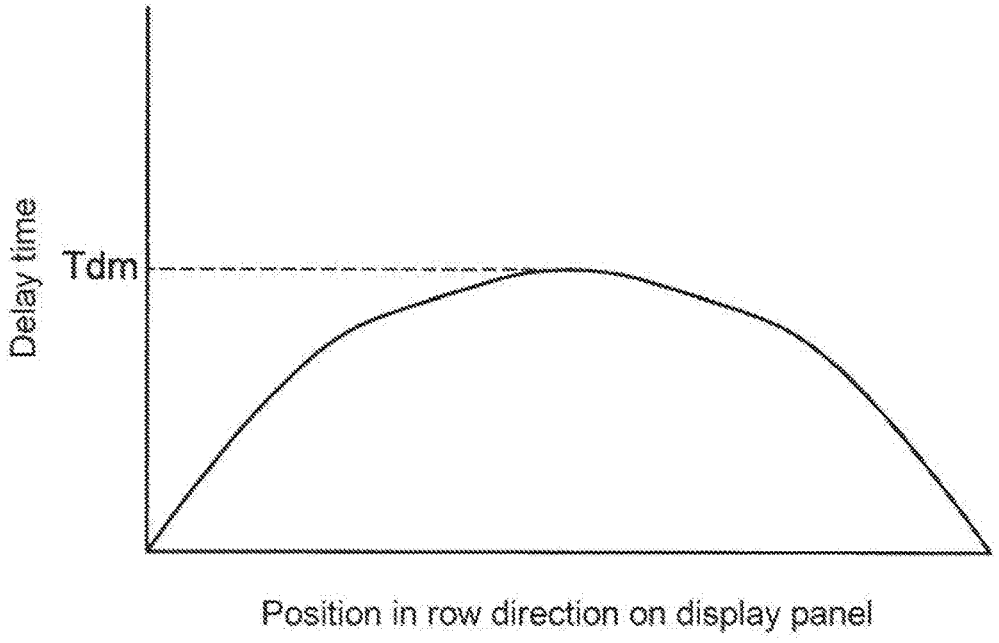
FIG. 3B shows a change in a delay time of the selection period in a group of pixels being connected to one scanning line.

Here, the scanning line S and the data line D are formed by forming a layer of metal such as tungsten or aluminum on a glass substrate, and can have electric resistance component and capacitive component. Therefore, in the scanning line signal 3S propagating through the scanning line S, for example, the signal waveform is deformed in conjunction with the propagation, causing a so-called rounding to occur. With reference to FIGS. 3A and 3B, an effect of rounding of the waveform of the scanning line signal 3S on displaying of the display panel 2 is explained.

FIG. 3A is a timing chart showing a delay of a selection period of the pixel 21 that can occur due to deforming of the waveform of the scanning line signal 3S. Changes in the level of the data line signal 4S in an n-th scan period T(n) and the scan periods therebefore and thereafter (V(n−1)→V(n)→V(n+1)) is shown in the upper stage in 3A. A waveform 3S_a and a waveform 3S_b of the scanning line signal 3S in each of A and B portions in FIG. 1 are shown in the middle and lower stages in FIG. 3A. While the pulse width (the period with the level to turn on the TFT) of the waveform 3S_a is the same as one scan period in the example in FIG. 3A, the pulse width is construed to be not limited to this example. The pulse width can be set longer or shorter than one scan period. Moreover, the pixel can be selected continuously (an overlapped drive) over two or more scan periods. The waveform 3S_b is determined according to deforming of the waveform in conjunction with propagation through the scanning line S with respect to the waveform 3S_a. For example, if the pulse width of the waveform 3S_a extends over two or more scan periods, the pulse width of the waveform 3S_b also extends over two or more scan periods.

As shown in FIG. 3A, the scanning line signal 3S has a generally square waveform in the A portion in FIG. 1, or, in other words, a portion being near to the scanning line drive unit 3*a* or the scanning line drive unit 3*b* in each scanning line S. Thus, in the pixel being positioned in the A portion, the level of the scanning line signal 3S rises above a gate threshold value Vth of the TFT generally simultaneously with a rise of the scanning line signal 3S, or, in other words, the start of one scan period (the n-th scan period). Then, the level of the scanning line signal 3S falls below the gate threshold value Vth generally simultaneously with a fall of the scanning line signal 3S, or, in other words, the end of one scan period (the n-th scan period). Therefore, TFT is being turned on during a period. Ta being generally the same as the n-th scan period T(n), causing this period Ta to be the selection period of the relevant pixel. Therefore, the selected pixel is suitably charged with a voltage according to a level V(n) of the data line signal 4S in a period Ta.

On the other hand, in the B portion in FIG. 1 or, in other words, a portion being relatively distal from both the scanning line drive units 3*a* and 3*b* in each scanning line S, the waveform of the scanning line signal 3S is deformed as shown in the lower stage in FIG. 3A. Thus, the level of the scanning line signal 3S rises above the gate threshold value of the TFT at the time being delayed relative to the start time of the rise of the scanning line signal 3S, and the level of the scanning line signal 3S falls below the gate threshold value of the TFT at the time being delayed relative to the start time of the fall of the scanning line signal 3S. Thus, the pixel near the B portion is selected during a period Tb being delayed relative to the n-th scan period T. However, the level of the data line signal 4S is already changed to a level V (n+1) before the period Tb is completed, so that the pixel near the B portion cannot be suitably charged with a voltage according to the level V (n). Therefore, even supplying generally the same level of data line signals 4S to the pixel near the A portion and to the pixel near the B portion can cause display non-uniformity between displaying near the A portion and displaying near the B portion. Such display non-uniformity easily becomes more noticeable when the time of one scan period becomes shorter. In other words, when the number of pixels becomes greater such as in an 8K display panel and/or the number of pictures displayed for each unit time (frame rate) becomes greater such as in the 120 Hz drive, a problem related to displaying due to deforming of the waveform of the scanning line signal 3S is more likely to occur.

FIG. 3B shows a change in a delay time of the selection period of a group of pixels being connected to one scanning line. In FIG. 3B, the horizontal axis shows the position in the row direction on the display panel 2. In other words, the delay time at the opposite ends in the horizontal axis show the delay time of the pixels at the opposite ends of the display panel in the row direction, while the delay time at the central portion of the horizontal axis shows the delay time of the pixel at the central portion of the display panel 2 in the row direction. As shown in FIG. 3B, the nearer to the scanning line drive unit 3*a* or the scanning line drive unit 3*b* the pixel is, the shorter the delay time thereof is, while the more distal thereto the pixel is, the longer the delay time thereof is. In other words, in the display apparatus 1 in which the scanning line drive unit is arranged at each of the opposite ends of the display panel 2 in the row direction, the delay time of the selection period is greatest in the pixel at the central portion of the display panel 2 in the row direction.

In a case that the selection period of each pixel of the display panel is delayed relative to the scan period, the output timing of the data line signal relative to the relevant scan period can be adjusted in accordance with the delay time to prevent an occurrence of display non-uniformity. However, as shown in FIG. 3B, in a case that the display panel has a delay property being not uniform with respect to the selection period of the group of pixels in the row direction, uniform displaying in the row direction of the display panel cannot be obtained even though the output timing of the data line signal is adjusted in a lump with respect to all of the data lines.

Then, in the display apparatus 1 according to the present embodiment, for each data line D, the output timing of the data line signal 4S is delayed relative to a predetermined reference time (for example, the start time of each horizontal period) such that the supply period of a desired voltage from the data line signal 4S is adapted to the delay of the selection period of each one of the plurality of pixels 21 in conjunction with the propagation delay of the scanning line signal 3S. In other words, the output timing of the data line signal 4S is delayed in accordance with the propagation delay of the scanning line signal 3S. According to the present disclosure, the term "propagation delay" of the scanning line signal 3S comprises not only a delay in the rise timing or the fall timing of the scanning line signal 3S, but also the deforming (rounding) of the waveform of the scanning line signal 3S that causes a delay in the selection period of the pixel 21 as described previously.

Again with reference to FIG. 3B, the delay time of the selection period reaches a maximum value Tdm. Therefore, in the display 2 having the delay property shown in FIG. 3B, to sufficiently suppress display non-uniformity due to the propagation delay of the scanning line signal 3S, preferably the data line signal 4S can be delayed by the maximum of time Tdm from the start of each horizontal period, for example. While the maximum value Tdm of the delay time depends on the screen size of the display panel 2 and the material of the scanning line S, according to a study by the present inventor, it has been found that the maximum value Tdm can be at least 0.5 microseconds in time in the 70-inch, 8K liquid crystal display panel.

On the other hand, as a means to delay the data line signal 4S by a time according to the propagation delay of the scanning line signal 3S to output the delayed data line signal 4S to each data line D, it is considered to provide, in the data line drive unit 4, two line memories each of which holds image data corresponding to one horizontal period. For example, image data corresponding to one horizontal period that is included in the image signal PS being sent from the timing control unit 5 is stored in a first line memory. Then, each image data corresponding to the data line signal 4S to be output to each data line D is successively input into a second line memory at an interval being a desired delay time and the input image data is output from the second line memory. As a result, the data line signal 4S can be output to each data line D with the data line signal 4S being delayed by a delay time according to each data line D from the specific timing, for example, the start time of each horizontal period.

However, with a method using two line memories in this way, the timing of inputting each image data into the second line memory is limited to within a blank period, in each horizontal period, being a period between display periods. The reason is that, in the following horizontal period, image data for the following horizontal period need to be input into the first line memory, so that all of the image data for the immediately preceding horizontal period that are being stored in the first line memory need to be input into the second line memory. Therefore, with the method using the two line memories, the length of delay time that can be realized in the data line drive unit 4 is limited to less than the length of a blank period in which the image signal PS is not transmitted from the timing control unit 5 in one horizontal period.

The length of the blank period depends on the number of pixels in the row direction, the frame rate, and the transmission rate of the image signal PS. For example, in a case of an 8K display panel, the frame rate of 120 Hz, and the transmission rate of 3.42 GHz, the blank period does not even reach 0.3 psec. Therefore, the propagation delay of the scanning line signal 3S that reaches 0.5 μsec or greater as described previously may not be corrected adequately just by providing two of the line memories. While even the propagation delay being the length of the blank period or more can be corrected when a further line memory is installed, the circuit size of the data line drive unit 4 increases. While the data line drive unit 4 is realized using a data line driver IC as described previously, a not so fine design rule being approximately 150 nm, for example, is primarily used for the data line driver IC. Thus, an increase in the circuit size by a further installation of one line memory increases the chip size of the driver IC and the cost.

Then, according to the present embodiment, generating of the delay of the data line signal 4S to be output to each data line D relative to the propagation delay of the scanning line signal 3S is carried out in each of the timing control unit 5 and the data line drive unit 4. In other words, correcting of the output timing of the data line signal 4S is carried out in two divided stages (below-described first and second corrections).

Figure 4A:
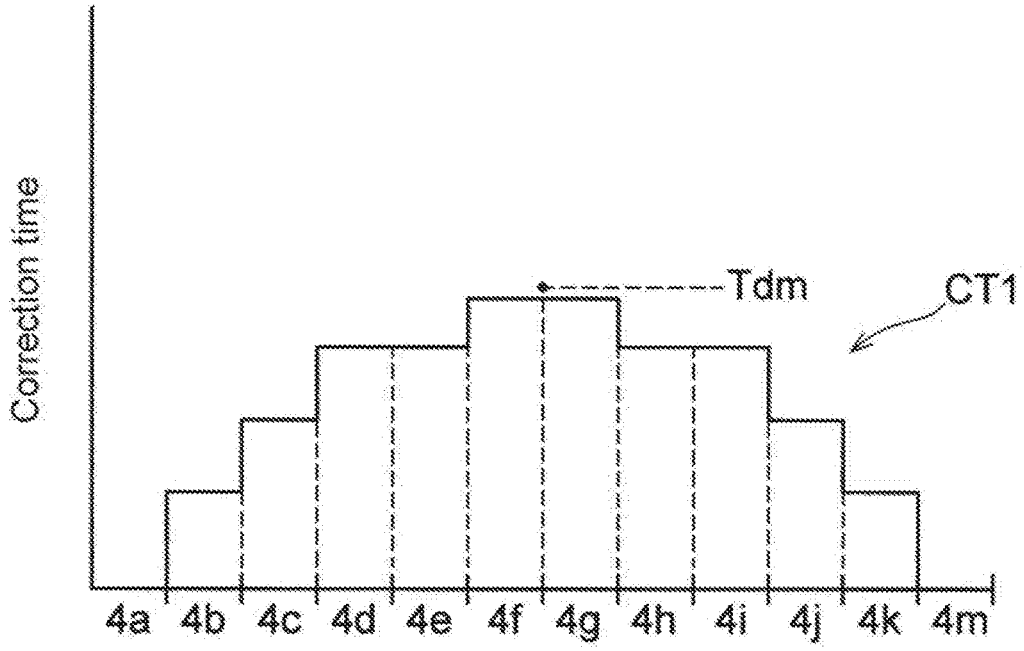
FIG. 4A shows one example of a correction time in a timing control unit according to one embodiment of the present disclosure.
Figure 4B:
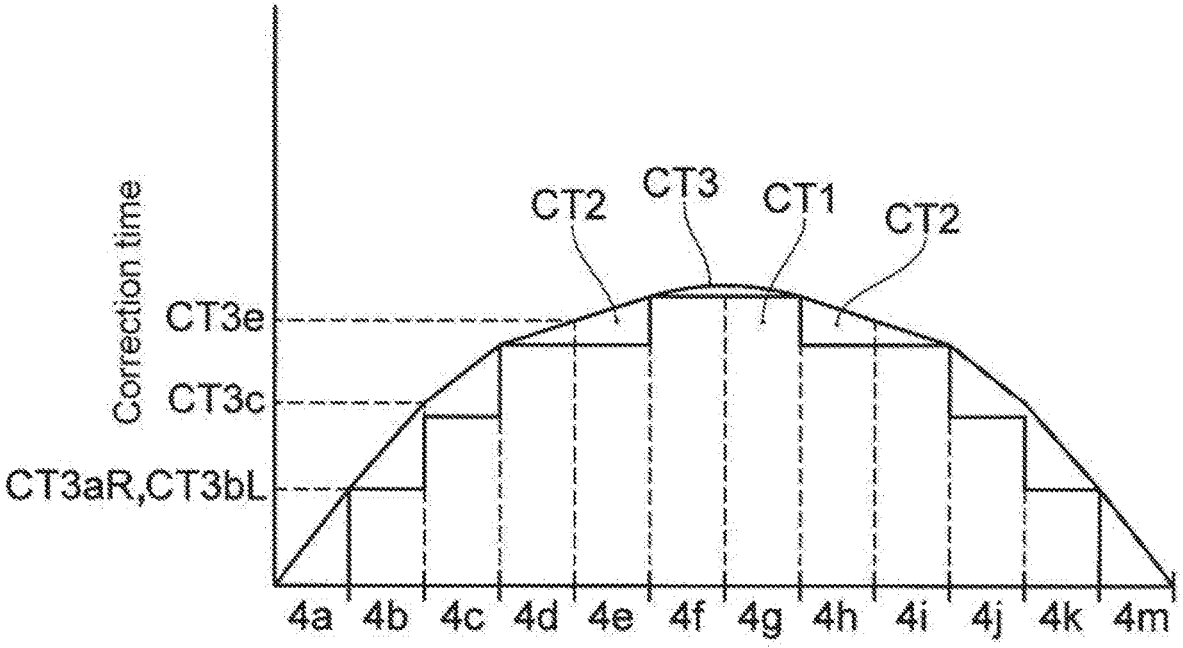
FIG. 4B shows one example of the correction time in the timing control unit and a data line drive unit according to one embodiment of the present disclosure.

FIG. 4A shows one example of a correction time (a first correction time CT1) in the timing control unit 5 of the display apparatus 1 according to the present embodiment. Moreover, FIG. 4B shows one example of a correction time in the timing control unit 5 and the data line drive unit 4. In FIGS. 4A and 4B, in the same manner as FIG. 3B, the horizontal axis indicates the position in the row direction on the display panel 2 in FIG. 1, and 4*a* to 4*n* (except 4*l*) being indicated on the horizontal axis indicate the twelve data line drive units 4*a* to 4*m* being lined up toward the right end from the left end of the display panel 2 in FIG. 1.

In the display apparatus 1, first, a correction in units of individual data line drive units (first correction) is carried out by the timing control unit 5. More specifically, the image signal of the relevant horizontal period is transmitted to each of the data line drive units 4*a* to 4*m* with a delay by the first correction time CT1 being set individually for each of the data line drive units 4*a* to 4*m* from the start time of transmission of an image signal corresponding to a group of pixels being lined up in the row direction to the plurality of data line drive units 4. In other words, the first correction time CT1 indicates the delay amount when the timing control unit 5 transmits the image signal. The first correction time CT1 is set based on the propagation delay of the scanning line signal 3S in the scanning line S (see FIG. 1).

For example, the first correction time CT1 for each data line drive unit 4 can be a delay time of the selection period of the pixel being connected to a data line (which is also called "a data line Dc") being proximate to the scanning line drive unit 3*a* or the scanning line drive unit 3*b* of the target data lines of each data line drive unit 4. Moreover, the first correction time CT1 can be a rise time or a fall time up to a predetermined level (potential) of the scanning line signal 3S at a cross point between the data line Dc and the scanning line S. The first correction time CT1 (and the below-described second correction time CT2) can be a time determined based on a result of an inspection to be carried out with respect to display non-uniformity while changing the delay time of the data line signal 4S so as to be adapted to the propagation delay of the scanning line signal 3S. Moreover, the first correction time CT1 can be the time being determined by a calculation using a time constant of the scanning line S up to one end S1 of the scanning line S from the cross point between the data line Dc and the scanning line S. However, the first correction time CT1 is construed to be not limited to the time being exemplified herein as long as it is the time having relevance to the propagation delay of the scanning line signal 3S.

In the example in FIG. 4A, the first correction time CT1 for the data line drive unit 4*a*, 4*m* being proximate to the scanning line drive unit 3*a* or the scanning line drive unit 3*b* in the example in FIG. 1 is zero. The first correction time CT1 increases in stages for each data line drive unit from the data line drive unit 4*b* to the data line drive unit 4*f*, and decreases in stages for each data line drive unit from the data line drive unit 4*g* to the data line drive unit 4*k*. The first correction time CT1 is the same between the data line drive unit 4*d* and the data line drive unit 4*e*, between the data line drive unit 4*f* and the data line drive unit 4*g*, and between the data line drive unit 4*h* and the data line drive unit 4*i*. The first correction time CT1 for each data line drive unit 4 can be arbitrarily set in accordance with the delay property of the scanning line signal 3S in the display panel 2.

In the timing control unit 5, correction is carried out in units of the respective data line drive units. Therefore, providing one line memory for each data line drive unit makes it possible to delay transmission of an image signal to each data line drive unit from the start time of transmission of an image signal corresponding to a group of pixels being lined up in the row direction to the plurality of data line drive units 4 up to the time corresponding to the length of one horizontal period. Therefore, as shown in FIG. 4A, the first correction time CT1 for the data line drive units 4*f*, 4*g* can also be set to a time being generally the same as the maximum value Tdm of the delay time to be corrected.

Moreover, a fine design rule being 55 nm, for example, is applied for an ASIC making up the timing control unit 5. Thus, even when a further line memory is installed, the chip size of the ASIC does not increase markedly, making an increase in cost unlikely. Moreover, in the timing control unit 5, a plurality of line memories is originally provided for each data line drive unit 4 for a purpose other than the first correction. Therefore, any of these line memories can also be shared for use as a line memory for the first correction. In this case, installation of a further line memory for carrying out the first correction can be unnecessary.

While most of the delay being required for correction of the propagation relay of the scanning line signal 3S can be realized with the first correction time CT1 in the timing control unit 5 as shown in FIG. 4A, the first correction time CT1 is a discrete correction time to be set for each of the data line drive units 4*a* to 4*m*. On the other hand, as shown in FIG. 3B referred to previously, the delay amount of the scanning line signal 3S continuously changes in the row direction of the display panel 2. Thus, with just the correction by the first correction time CT1 shown in FIG. 4A, luminance non-uniformity between pixels in border portions of the data line drive units 4*a* to 4*m* (so-called block separation) can occur. However, it is difficult to generate the image signal comprising delay information for each of the data lines D in the timing control unit 5. Then, according to the present embodiment, a correction (a second correction) is carried out for the propagation delay of the scanning line signal 3S by delaying the data line signal 4S for each data line D in the data line drive units 4*a* to 4*m* in addition to the delay for each of the data line drive unit 4*a* to 4*m* by the timing control unit 5.

In FIG. 4B, a total correction time CT3 is shown in addition to the first correction time CT1. The total correction time CT3 is plotted for target data lines of each of the data line drive units 4*a* to 4*m* being lined up on the horizontal axis in FIG. 4B (for example, a group of data lines consisting of the data lines D1 to Dn connected to the data line drive unit 4*a* in FIG. 1). For example, in FIG. 4B, a total correction time CT3*c* at a position at which the first correction CT1 increases at a border portion between the data line drive unit 4*b* and the data line drive unit 4*c* in FIG. 4B is a total correction time for the data line D1 of the data lines being connected to the data line drive unit 4*c*.

The total correction time CT3 is a correction time obtained by combining the first correction time CT1 and a correction time for a second correction (the second correction time CT2) to be carried out for each of the data line signals 4S to be output to the target data lines in each of the data line drive units 4*a* to 4*m*. In the example in FIG. 4B, the total correction time CT3 is the sum of the first correction time CT1 and the second correction time CT2, and the difference between the total correction time CT3 and the first correction time CT1 is the second correction time CT2. The second correction time CT2 is set for each of the two or more target data lines (for example, the data lines D1 to Dn) of each of the data line drive units 4*a* to 4*m*. The second correction time CT2 is set based on the propagation delay of the scanning line signal in the scanning line S, and indicates the delay amount when each of the respective data line drive units 4*a* to 4*m* outputs the data line signal 4S.

For example, the second correction time CT2 for each data line D can be a delay time of a selection period in a pixel being connected to each data line D. Moreover, the second correction time CT2 can be a rise time or a fall time up to a predetermined level (potential) in the scanning line signal 3S at a cross point between each data line D and the scanning line S. The second correction time CT2 can be a time being determined by a calculation using the time constant of the scanning line S to the one end S1 of the scanning line S from the cross point between each data line D and the scanning line S. However, the second correction time CT2 is construed to be not limited to the time being exemplified herein as long as it is the time having relevance to the propagation delay of the scanning line signal 3S.

In this way, a second correction for each data line signal 4S to be output to each data line D is carried out in each of the data line drive units 4*a* to 4*m* in addition to the first correction in the timing control unit 5. The output timing of the data line signal 4S to each data line signal D is corrected by the total correction time CT3 obtained by combining the first correction time CT1 and the second correction time CT2. As a result, for each group of pixels being lined up in the row direction, the data line signal 4S is delayed from the output time of the data line signal 4S to a data line (the data line Dc) being proximate to the scanning line drive unit 3*a* (or the scanning line drive unit 3*b*) by an amount of difference between the total correction time CT3 for the data line Dc and the total correction time CT3 for each of the other data lines D, and is output to each of the relevant data lines D. The data line signal 4S is output to each of the target data lines of one data line drive unit 4 at the times being mutually different by the differences in the second correction time CT2 for each of the relevant target data lines. In other words, to each of the target data lines of each of the data line drive units 4 for which the same first correction time CT1 is set, the data line signal 4S is output at the times being mutually different by an amount of differences in the second correction time CT2 for each of the relevant target data lines. On the other hand, to each of the data lines D for which the same second correction time CT2 is set, the data line signal 4S is output at the times being mutually different by an amount of differences in the first correction time CT1 being set for each of the data line drive units 4 to which each of the relevant data lines D is connected.

For example, in FIG. 4B, as described previously, the correction time CT3*c* is a total correction time for the data line D1 of the target data lines of the data line drive unit 4*c*. Moreover, a correction time CT3*e* is a total correction time for the data line D1 of the target data lines of the data line drive unit 4*e*, The data line drive unit 4*e* is arranged farther from an end of the display panel 2, the end at which a scanning line drive unit (the scanning line drive unit 3*a* being closer to the data line drive unit 4*c* and the data line drive unit 4*e* relative to the scanning line drive unit 3*b* in FIG. 1) is arranged, than the data line drive unit 4*c*. A data line signal is output, to the target data line D1 of the data line drive unit 4*e*, with a delay from the target data line D1 of the data line drive unit 4*c*, the delay being the difference between the correction time CT3*e* and the correction time CT3*c*.

In this way, for one group of pixels being lined up in the row direction a time difference Tdd between a time point at which the data line signal 4S is output to one data line (below, a data line Dx) and a time point at which the data line signal 4S is output to the other data line (below, a data line Dy) of the plurality of data lines D is equal to the difference between the total correction times CT3 for each of the data lines Dx and Dy. In other words, the time difference Tdd is equal to the difference between the sum of the first correction time CT1 being set for a data line drive unit to which the data line Dx is connected and the second correction time CT2 being set for the data line Dx and the sum of the first correction time CT1 being set for a data line drive unit to which the data line Dy is connected and the second time CT2 being set for the data line Dy.

Moreover, as shown in FIG. 1, in a case that the plurality of data line drive units 4 are arrayed in the row direction of the display panel 2 and the scanning line drive unit 3*a* (and/or the scanning line drive unit 3*b*) is arranged at the end of the display panel 2 in the row direction, each of the first correction time CT1 and the second correction time CT2 can be set as per below. The first correction time CT1 being equal to or greater than the first correction time CT1 set for one data line drive unit (first data line drive unit) of two of the data line drive units is set for another data line drive unit (second data line drive unit) being arranged farther from an end of the display panel 2, at which the scanning line drive unit 3*a* (or the scanning line drive unit 3*b*) is arranged, than the first data line drive unit. The first and second data line drive units can respectively be any one of the data line drive units 4*a* to 4*m*, or can be neighboring data line drive units. Moreover, in a case that the scanning line drive units (the scanning line drive unit 3*a* and the scanning line drive unit 3*b*) are arranged at the opposite ends of the display panel 2 as shown in FIG. 1, the scanning line drive unit to be an object to determine the farness/nearness with respect to the first data line drive unit and the second data line drive unit as described above is a scanning line drive unit being nearer to the first and second data line drive units.

The second correction time CT2 being equal to or greater than the second correction time CT2 set for one target data line (first target data line) of two of the target data lines of each data line drive unit is set for another target data line (second target data line) being arranged farther from an end of the display panel 2, at which the scanning line drive unit 3*a* (or the scanning line drive unit 3*b*) is arranged, than the first target data line. The first and second target data lines can be any of the data lines D1 to Dn to be connected to each data line drive unit 4 or can be neighboring data lines. Moreover, in a case that the scanning line drive units (the scanning line drive unit 3*a* and the scanning line drive unit 3*b*) are arranged at the opposite ends of the display panel 2 as shown in FIG. 1, the scanning line drive unit to be an object to determine the farness/nearness with respect to the first target data line and the second target data line as described above is a scanning line drive unit being nearer to the first and second data lines.

In each of the data line drive units 4*a* to 4*m*, a correction can be carried out with a fine increasing/decreasing step, or, in other words, a minute increasing/decreasing step (unit length of time) with respect to a correction time, for each data line signal 4S to be output to each data line D using two line memories as described previously, for example. Therefore, the total correction time CT3 can be brought closer to the continuously changing delay time property of the scanning line signal 3S. Even more, as a correction being great in the correction amount is carried out by the timing control unit 5, a great propagation delay of the scanning line signal 3S such as to exceed a blank period can be corrected adequately even in a case that the data line drive unit 4 comprises only two line memories, Therefore, an occurrence of display non-uniformity can be suppressed well without inviting an increase in cost of the data line drive unit 4.

[Timing Control Unit]

Figure 5:
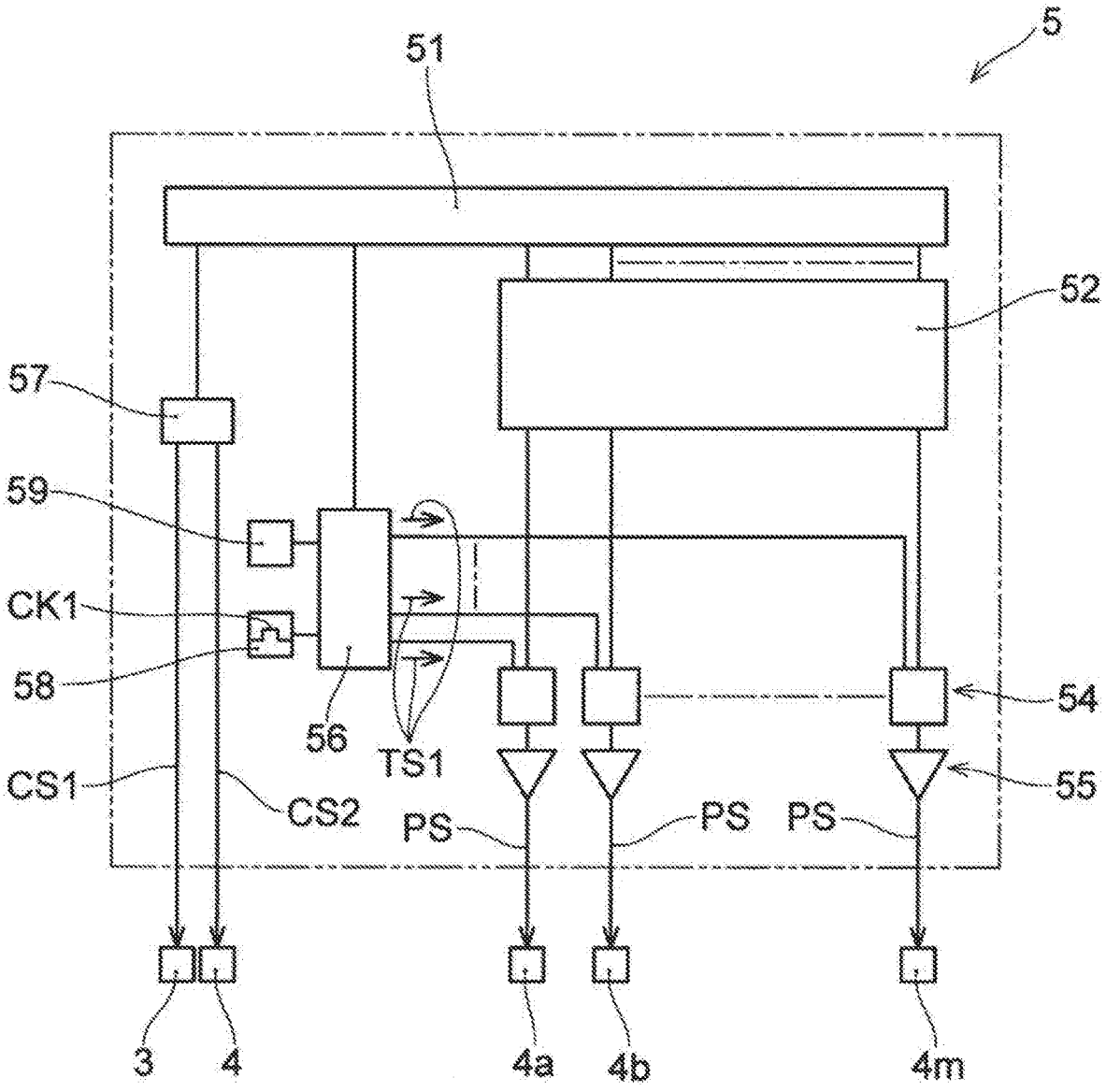
FIG. 5 is a block diagram showing one example of the configuration of the timing control unit according to one embodiment of the present disclosure.

FIG. 5 shows one example of the configuration of the timing control unit 5 according to the present embodiment. The timing control unit 5 comprises a reception circuit 51, an image processing circuit 52, an image signal storage circuit 54, an output buffer 55, a first timing generating circuit 56, and a control signal generating circuit 57. The control signal generating circuit 57 generates the control signal CS1 to transmit the generated control signal CS1 to the scanning line drive units 3*a* and 3*b* and generates the control signal CS2 to transmit the generated control signal CS2 to each data line drive unit 4. The control signal CS2 can be embedded into the image signal PS to be transmitted to the data line drive unit 4*a* to 4*m*.

Each of the image signal storage circuit 54 and the output buffer 55 is provided for each of the data line drive units 4*a* to 4*m*. Therefore, each of the image signal storage circuit 54 and the output buffer 55 is provided in a plurality. In the display apparatus 1 in the example in FIG. 1, the output of each output buffer 55 is output to each of the data line drive units 4*a* to 4*m*.

Video data and synchronization signal are input from a host circuit (not shown) into the timing control unit 5. The input video data and synchronization signal are received in the reception circuit 51 and input into the image processing circuit 52. In units of display images, the image processing circuit 52 carries out a gamma conversion, an overdrive conversion, and a dithering conversion to generate an image signal, and the image processing circuit 52 allocates the generated image signal in units of the respective data line drive units to output the allocated image signal to each image signal storage circuit 54.

Each image signal storage circuit 54 is configured with a line memory to store an image signal for one horizontal period. In a case that 960 data lines D are connected to each of the respective data line drive units 4*a* to 4*m*, each image signal storage circuit 54 has a memory capacity corresponding to the 960 data lines. Each image signal storage circuit 54 holds an image signal being input from the image processing circuit 52 for one horizontal period at a maximum. Below, explanations will be given with an exemplary case of using, as the image signal storage circuit 54, a dual port line memory, or, in other words, a line memory of a type in which writing and reading can be carried out simultaneously and write and read addresses can be controlled independently. As a matter of course, other types of line memory can be used.

Based on the previously-described first correction time CT1 and a first clock signal CK1 of a predetermined frequency, the first timing generating circuit 56 generates a first timing signal TS1 for each one of the plurality of data line drive units (the data line drive units 4*a* to 4*m* in the display apparatus 1 in the example in FIG. 1). The timing control unit 5 in the example in FIG. 5 further comprises a clock generating circuit 58 to generate the first clock signal CK1 and a correction time storage unit 59 to store the first correction time CT1 (a first correction time storing unit). Information on the first correction time CT1 can be stored in a non-volatile memory such as a flash memory (not shown), in which case the stored information can be transferred to the correction time storage unit 59 from the non-volatile memory at the time of activating the timing control unit 5.

The original oscillation of the clock generating circuit 58 can either utilize an oscillating element such as a crystal, or a clock received with video data from a host system (not shown) in the reception circuit 51. Based on the original oscillation, a conversion to a desired frequency can be carried out using a multiplying circuit or a dividing circuit such as a PLL (phase locked loop), or, furthermore, an EMI reduction can be sought further by conducting spread spectrum (SS).

The first tinning generating circuit 56 grasps the first correction time CT1 for each of the data line drive units 4*a* to 4*m* by referring to the correction time storage unit 59, for example. Moreover, based on the horizontal synchronization signal received in the reception circuit 51, the first timing generating circuit 56 specifies the start timing of transmission of the image signal, to the plurality of data line drive units 4, corresponding to a group of pixels being lined up in the row direction (below, this start timing of transmission is also called merely "the image signal-transmission-start timing for each row") The image signal-transmission-start timing for each row is the start time of the horizontal period in a data line drive unit being proximate to the scanning line drive unit 3*a* or the scanning line drive unit 3*b*, for example. Moreover, the first timing generating circuit 56 determines elapsing of time from the image signal-transmission-start timing for each row by counting the first clock signal CK1. Then, the first timing generating circuit 56 transmits, in order, the first timing signal TS1 to each of the image signal storage circuits 54 for each elapsing of time according to the first correction time CT1 for each of the data line drive units 4*a* to 4*m* from the image signal-transmission-start timing for each row.

Based on the first timing signal TS1 being sent from the first timing generating circuit 56, each image signal storage circuit 54 starts reading of an image signal being stored to start outputting of the image signal to each corresponding output buffer 55. An image signal from the image processing circuit 52, an image signal to be input to the image signal storage circuit 54, and an image signal to be output from the image signal storage circuit 54 are serialized digital signals. At the image signal-transmission-start timing for each row, the image signal storage circuit 54 starts writing of the image signal from the image processing circuit 52 in order from the first address of the image signal storage circuit 54. Then, the image signal storage circuit 54 starts reading, in order, from the first address at a time point at which the time according to the first correction time CT1 elapses from the start of writing the image signal.

Each output buffer 55 transmits an image signal to each of the data line drive units 4*a* to 4*m*. Therefore, the image signal PS of the relevant horizontal period for each data line drive unit is transmitted, from each output buffer, to each of the data line drive units 4*a* to 4*m* with a delay from the image signal-transmission-start timing for each row by the first correction time CT1 according to each of the data line drive units 4*a* to 4*m*. For example, in this way, a first correction by the timing control unit 5 for the propagation delay of the scanning line signal 3S is carried out for each of the data line drive units 4*a* to 4*m*.

In this way, in the display apparatus 1 according to the present embodiment, the timing control unit 5 transmits the image signal PS, for each group of pixels being lined up in the row direction, with a delay from the start time of transmission of the image signal PS with respect to the relevant group of pixels being lined up in the row direction to the plurality of data line drive units 4 by the first correction time CT1 being set for each one of the plurality of data line drive units 4, the image signal PS being transmitted to each of the relevant data line drive units 4. Then, the timing control unit 5, based on the first clock signal. CK1, delays transmission of the image signal PS to each one of the plurality of data line drive units 4 by the first correction time CT1.

A clock signal for use in generating the first timing signal TS1 can be transmitted to the data line drive units 4*a* to 4*m* as a part of the control signal CS2 or while being embedded into the image signal PS.

[The Data Line Drive Unit]

Figure 6:
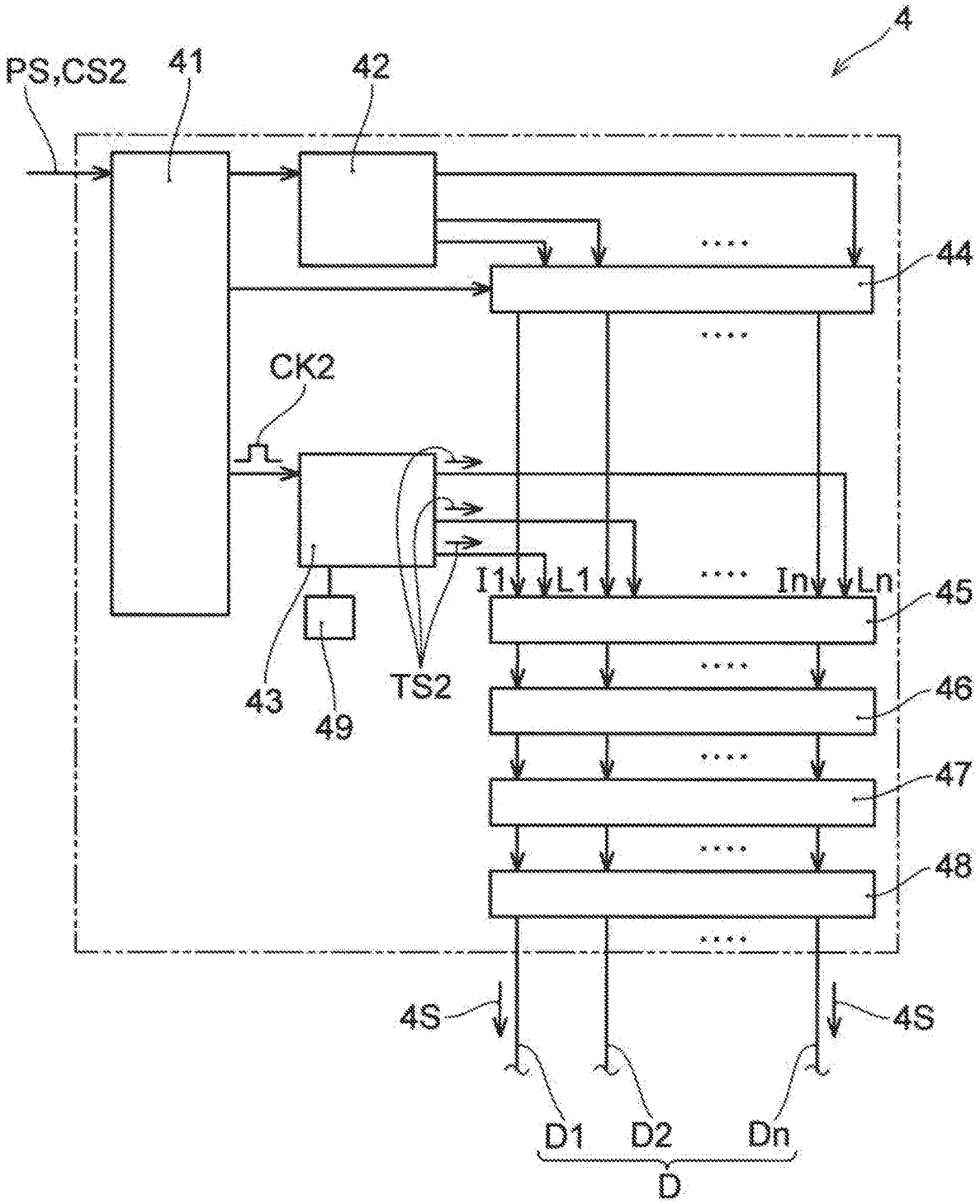
FIG. 6 is a block diagram showing one example of the configuration of the data line drive unit according to one embodiment of the present disclosure.

FIG. 6 shows one example of the configuration of the data line drive unit 4 according to the present embodiment. The data line drive unit 4 comprises a reception circuit 41, a shift register 42, a second timing generating circuit 43, a first image data storage circuit 45, a second image data storage circuit 44, a level shifter 46, a D/A converter 47, and an output buffer 48. The image signal PS and the control signal CS2 to be supplied to the data line drive unit 4 are received in the reception circuit 41 and sent to each of the other circuits.

Image data consisting of 10 bits, for example, and including luminance information (grayscale information) of each pixel 21 (see FIG. 1) in each horizontal period is extracted from the image signal PS to be output serially to the second image data storage circuit 44. On the other hand, a synchronization signal being synchronized with the image data is input to the shift register 42 and a control signal based on the synchronization signal is input to the second image data storage circuit 44 from the shift register 42, The second image data storage circuit 44 is configured with a line memory to store therein image data in one horizontal period, for example. The second image data storage circuit 44 stores image data for each of two or more target pixels being extracted from the image signal PS with respect to two or more target pixels being connected to the target data lines of each data line drive unit 4 (for example, data lines from the data line D1 to the data line Dn of the data line drive unit 4*a* in the example in FIG. 1, for example). The second image data storage circuit 44 captures and latches, in order, image data being serially sent thereto into a storage space for each of the target data lines. The storage space to latch therein each image data set being serially sent is controlled by a control signal from the shift register 42. The second image data storage circuit 44 parallelly outputs each image data set being latched in each storage space to the first image data storage circuit 45.

The first image data storage circuit 45 is configured with a line memory to store therein image data in one horizontal period, for example. In the same manner as the second image data storage circuit 44, the first image data storage circuit 45 stores image data for each of two or more target pixels being extracted from the image signal PS with respect to the two or more target pixels being connected to the target data lines of each data line drive unit 4. The first image data storage circuit 45 stores each image data set corresponding to each target data line in a storage space being provided for each target data line for each image data set. The first image data storage circuit 45 has data ports I1 to In to which image data is input and control ports L1 to Ln for each storage space. A second timing signal TS2 is input from the second timing generating circuit 43 to the control ports L1 to Ln. At the timing in which a rising edge or a falling edge of the second timing signal TS2 is input to each of the control ports L1 to Ln, an image data set being input to each of the corresponding input ports I1 to In is latched in the corresponding storage space.

The second timing generating circuit 43 generates the second timing signal TS2 based on the previously-described second correction time CT2 for each target data line and a second clock signal CK2. In the example in FIG. 6, the data line drive unit 4 further comprises a correction time storage unit 49 (a second correction time storage unit) to store therein the second correction time CT2. For example, the second timing generating circuit 43 grasps the second correction time CT2 for each target data line by referring to the correction time storage unit 49. Moreover, based on a control signal such as a start pulse being received in the reception circuit 41, the second timing generating circuit 43 grasps the output reference time with respect to two or more target pixels being connected to the target data lines (the data lines D1 to Dn).

"The output reference time" is the timing at which outputting of the data line signal 4S to the target data lines is started in each horizontal period in a case that the second correction is not carried out. "The output reference time" can be an arbitrary timing in the horizontal period of each data line drive unit 4 as long as the decision criteria of "the output reference time" match between each of the data line drive unit 4. For example, the output reference time can be a time point (a first time point) at which each data line drive unit 4 starts reception of the image signal PS with respect to the own target pixels, or, in other words, the start time point of the previously-described display period. Moreover, the output reference time can be a time point (a second time point) at which each data line drive unit 4 completes reception of the image signal PS with respect to the own target pixel, or, in other words, the start time point of the previously-described blank period. Alternatively, the output reference time can be a time point (a third time point) after a predetermined time elapses from the first time point or the second time point. While "the predetermined time" can be determined arbitrary, "the predetermined time" is the time being set in advance as the time corresponding to the delay time from inputting to outputting of each of constituting elements of each data line drive unit 4 or as the time corresponding to the total time of the delay times of the respective constituent elements. "The predetermined time" is stored in the second timing generating circuit 43 or the correction time storage unit 49, for example.

The second timing generating circuit 43 determines the time from the output reference time by counting the second clock signal CK2. The second timing generating circuit 43 transmits, in order, the second timing signal. TS2 to the control ports L1 to Ln of the first image data storage circuit 45 for each elapsing of the time according to the second correction time CT2 for each target data line from the output reference time.

When the second timing signal TS2 is input to each of the control ports L1 to Ln, the first image data storage circuit 45 latches image data for each of two or more target pixels being input to each of corresponding input ports I1 to In in a corresponding storage space. Then, the first image data storage circuit 45 outputs the latched image data to the level shifter 46. In this way, the second image data storage circuit 45 latches and outputs image data based on the image signal PS of one horizontal period for each data line drive unit 4, based on the second timing signal TS2.

A predetermined conversion is carried out in the level shifter 46 and the D/A converter 47 to the image data set being output for each target data line from the first image data storage circuit 45, and the converted image data set is output as the data line signal 4S to the target data lines (for example, data lines D1 to Dn) from the output buffer 55. Each image data set being output from the first image data storage circuit 45 is output to each target data line without being delayed intentionally on an individual basis. Therefore, the respective data line signals 4S to be output to each target data line are respectively output with a delay by a time according to the second correction time CT2 from the output reference time. In this way, each data line drive unit 4, based on the second clock signal. CK2, outputs the data line signal 4S to each of the target data lines with a delay from the output reference time with respect to two or more target pixels by the second correction time CT2 being set for the relevant target data line.

In a case that the output reference time is the previously-mentioned second time point, the timing at which the first image data storage circuit 45 latches each image data set in accordance with inputting of the second timing signal TS2 is set within the blank period in which each data line drive unit 4 does not receive the image signal PS in each horizontal period of each data line drive unit 4. This is because, as described previously, latching of the image data for the following horizontal period is started in the second image data storage circuit 44 once the blank period is exceeded. Therefore, the time difference between the earliest input timing and the latest input timing of the second timing signal TS2 to each of the control ports L1 to Ln of the first image data storage circuit 45 is shorter than the blank period. In other words, the maximum value of the second correction time CT2 is shorter than the blank period of each horizontal period.

According to the present embodiment, in each data line drive unit 4, the second timing signal TS2 is generated using the second clock signal CK2. In other words, each data line drive unit 4 determines the timing at which each of the data line signals 4S is output to each data line with a delay by the second correction time CT2, based on the second clock signal CK2. When outputting of the data line signal is controlled by adjusting of the slew rate of an outputting circuit, the delay amount changes due to the temperature characteristics and/or manufacturing variations and/or target voltages before and after change, so that an accurate correction is possibly not carried out. While the distribution of the correction amount within the panel surface should be set as being gradually continuous, the correction amount drastically changing in a discontinuous manner (a fault-like manner) in the border of the data line drive units being positioned adjacent to each other in the display panel 2, for example, causes a salient defect in display quality, which is called the previously-described block separation. However, according to the present embodiment, the output timing of the data line signal 4S to be delayed is determined in the digital domain using a clock signal, making it possible to stably carry out a minute correction.

In the example in FIG. 6, the second clock signal CK2 is extracted from the image signal PS or the control signal CS2 being received in the reception circuit 41 and supplied to the second timing generating circuit 43. The second clock signal CK2 can be generated in the timing control unit 5 (see FIG. 5) or can be generated in a host system (not shown) and sent to the data line drive unit 4 via the timing control unit 5. The second clock signal CK2 can be also generated in the data line drive unit 4.

In the display apparatus 1 according to the present embodiment, the first correction is carrier out in the timing control unit 5 and the second correction is carried out in the data line drive unit 4, therefore, it is preferable that the commonality between clock signals used to generate the timing in each correction should be high since a correction can be carried out accurately. Thus, it is desirable that the first clock signal CK1 (see FIG. 5) to be used in the timing control unit 5 and the second clock signal CK2 to be used in the data line drive unit 4 be synchronized with each other. The first clock signal CK1 and the second clock signal CK2 can be synchronized with each other by being generated by the same original oscillation circuit, by being generated by multiplying or dividing the original oscillation, or by being generated by multiplying or dividing the original oscillation, for example.

Moreover, in a case that the previously-described. SS is conducted for the first clock signal CK1 and the second clock signal CK2, the first clock signal CK1 and the second clock signal CK2 can be generated by using the same SSCG (SSCG: spread spectrum clock generator, SS clock generating circuit), by multiplying or dividing clock signals being generated by the same SSCG, or by multiplying and dividing clock signals being generated by the same SSCG.

As clocks being generated by different SSCGs are not synchronized with each other, the SS profile phases differ even though the average frequencies are the same over a long time, so that the clock frequencies in each time instance easily differ. Therefore, when timing signals are generated using the clocks generated by the different SSCGs, an error easily increases. Moreover, the modulation frequency of the SS is generally in the order of kHz, so that interference easily occurs with the scanning line drive period to be the frequency in the same order of kHz. For example, in a case of the SS with ±0.5%, 30 kHz, and triangular modulation, the maximum value of instantaneous error can reach 83.3 ns.

Directing attention to the border between the data line drive unit 4*a* and the data line drive unit 4*b* in FIG. 4B, for example, a total correction time CT3*a*R on the right end of the data line drive unit 4*a* is made up of only the second correction time CT2, while a total correction time CT3*b*L on the left end of the data line drive unit 4*b* is made up of only the first correction time CT1. Thus, in a case that the commonality is low between the first clock signal CK1 and the second clock signal CK2, an error occurs between the total correction time CT3*a*R and the total correction time CT3*b*L, causing the curve of the correction time in FIG. 4B to drastically change in a discontinuous manner at the border between the data line drive unit 4*a* and the data line drive unit 4*b*. As described previously, when the correction amount drastically changes in a discontinuously manner (in a fault-like manner) at the border between the data line drive units being positioned adjacent to each other, block separation easily occurs. According to a study by the present inventor, in a case that a 120 Hz drive is carried out in the 70-inch 8K liquid crystal display panel, for example, it has been found that, when the change width of the correction amount which changes in a fault-like manner between neighboring data line drive units reaches approximately 5 ns or greater, a phenomenon of block separation starts to be visually recognized. Therefore, the previously-described first timing generating circuit 56 (see FIG. 5) desirably uses the first clock signal CK1, for generating the first timing signal TS1, sharing an original oscillation circuit or an SSCG with the second clock signal. CK2 to be used in the second timing generating circuit 43. Both of the clock signals do not necessarily have to share the original oscillation circuit or the SSCD.

Moreover, transmission of the image signal PS to the data line drive unit 4 from the timing control unit 5 is carried out primarily using a transmission clock, so that the transmission clock can be used for the first clock signal CK1 and/or the second clock signal CK2. For example, the second clock signal CK2 and/or the first clock signal CK1 can be a multiplied clock signal or a divided clock signal, or a multiplied and divided clock signal of the transmission clock being used to transmit the image signal PS to the plurality of data line drive unit 4 from the timing control unit 5. A clock signal being suited to the first correction and/or the second correction can be obtained easily. A clock embedded scheme to embed a transmission clock in a data signal to be transmitted, such as image information and control information, can be adopted for the transmission clock to be used in transmitting the image signal PS to the data line drive unit 4 from the timing control unit 5.

While each of the first correction time CT1 and the second correction time CT2 is stored in each storage unit in FIGS. 5 and 6, the number of clocks in the first clock signal CK1 corresponding to the first correction time CT1 and the number of clocks in the second clock signal CK2 corresponding to the second correction time CT2 can be stored in each storage unit. Moreover, the first correction time cm or the number of clocks in the first clock signal CK1 corresponding to the first correction time CT1 can be stored in a non-volatile memory such as a flash memory (not shown) and transferred to the correction time storage unit 59 from the non-volatile memory at the time of activating the timing control unit 5. Furthermore, the second correction time CT2 or the number of clocks in the second clock signal CK2 corresponding to the second correction time CT2 can be stored in the non-volatile memory such as the flash memory (not shown), and transferred to the timing control unit 5 from the non-volatile memory at the time of activating the timing control unit 5, and further sent with the control signal CS2 to the data line drive unit 4 from the timing control unit 5.

According to the present embodiment, a first correction is carried out in the timing control unit 5, making it possible to make a correction time with respect to the output timing of the data line signal 4S greater than a conventional technology, while each data line drive unit 4 comprises only two line memories to store image data as the first image data storage circuit 45 and the second image data storage circuit 44. For example, as described previously, from outputting of a data line signal to one data line, a data line signal can be output to another data line with a delay being greater than the blank period in each horizontal period.

[Example of First Correction]

Figure 7A:
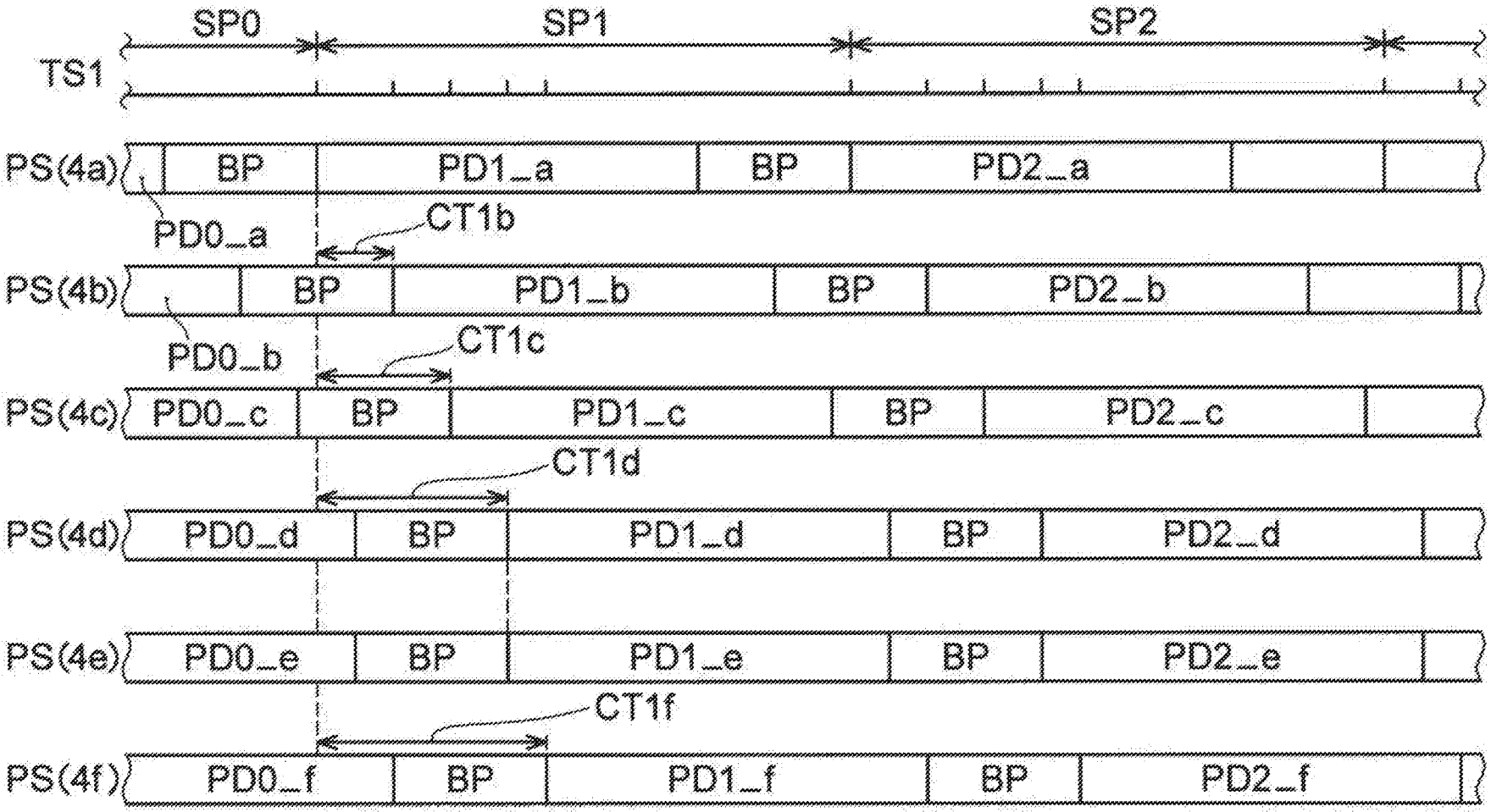
FIG. 7A shows one example of the transmission tinning of an image signal from the timing control unit to each data line drive unit according to one embodiment of the present disclosure.

FIG. 7A shows one example of the transmission timing of an image signal to each data line drive unit from the tinning control unit of the display apparatus according to the present embodiment. FIG. 7A shows an image signal PS to be transmitted to each data line drive unit 4 with a first correction being carried out by the timing control unit 5 of the display apparatus 1 in the example in FIG. 1. In FIG. 7A, PS(4*a*) to PS(4*f*) indicate each image signal to be transmitted to each of the data line drive units 4*a* to 4*f*. In the explanations below with reference to FIG. 7A (or with reference to FIG. 7C or FIG. 8C), "the image signal-transmission-start timing for each row" in the timing control unit 5 is the start timing of transmission of the image signal PS to the data line drive unit 4*a*, In other words, in FIGS. 7A, 7C, and 8C, the first correction time for the data line drive unit 4*a* is zero.

FIG. 7A shows the image signal PS to be transmitted to each data line drive unit 4 in three arbitrary consecutive horizontal periods SP0 to SP2. The start timing of each of the horizontal periods SP0 to SP2 differs for each data line drive unit 4 and the horizontal periods SP0 to SP2 shown in FIG. 7A indicate the horizontal periods in the data line drive unit 4*a*. (The same applies to FIGS. 7B, 7C, and 8C.) Illustration of the horizontal periods SP0 to SP2 in the data line drive units 4 other than the data line drive unit 4*a* will be omitted. PD0_*x* to PD2_*x* (x: a to f) respectively indicate image data to be included in an image signal to be transmitted to each data line drive unit in the horizontal periods SP0 to SP2. Therefore, the start timing of a horizontal period SP1 in each data line drive unit 4 is a start time point of image data PD1_*x* in each of the image signals PS(4*a*) to PS(4*f*), while the start timing of the horizontal period SP2 in each data line drive unit 4 is a start time point of the image data PD2_*x* in each of the image signals PS(4*a*) to PS(4*f*). Moreover, "BP" is a blank period in each horizontal period. In FIG. 7A, individual first timing signals TS1 to be input to each image signal storage circuit 54 (see FIG. 5) in the timing control unit 5 are shown collectively on one line.

In FIG. 7A, the start time of the horizontal period SP1 in the data line drive unit 4*a* is the image signal-transmission-start timing for a row with respect to the image signal PS to be transmitted in the horizontal period SP1. Moreover, the start time of the horizontal period SP2 in the data line drive unit 4*a* is the image signal-transmission-start timing for a row with respect to the image signal PS to be transmitted in the horizontal period SP2. As shown in FIG. 7A, when the horizontal period SP1 in the data line drive unit 4*a* starts, the timing signal TS1 is input to the image signal storage circuit 54 for the data line drive unit 4*a*. Then, the image signal PS(4*a*) including image data PD1_*a* is transmitted to the data line drive unit 4*a*. Thereafter, the first timing signal TS1 is input to the image signal storage circuit 54 for the data line drive unit 4*b* after elapsing of a first correction time CT1*b* for the data line drive unit 4*b* from the start of the horizontal period SP1 in the data line drive unit 4*a*. Then, an image signal PS(4*b*) including image data PD1_*b* is transmitted to the data line drive unit 4*h*. Thereafter, the first timing signal TS1 is successively input to the image signal storage circuits 54 for the data line drive units 4*c* to 4*f* after elapsing of first correction times CT1*c* to CM for the respective data line drive units 4*c* to 4*f* from the start of the horizontal period SP1 in the data line drive unit 4*a*. Then, image signals PS(4*c*) to PS(4*f*) including corresponding image data (any one of image data PD1_*c* to PD1_*f*) are successively transmitted to the respective data line drive units 4*c* to 4*f*. The same first correction time CT1*d* is set for the data line drive unit 4*d* and the data line drive unit 4*e*. In this way, the same first correction time can be set for the neighboring data line drive units 4.

In the horizontal period. SP2 as well, the first timing signal TS1 is successively input to the image signal storage circuits 54 for the respective data line drive units 4*a* to 4*f* after elapsing of the first correction time for each of the data line drive units 4*a* to 4*f* from the start of the horizontal period SP2 in the data line drive unit 4*a*. Then, the image signals PS(4*a*) to PS(4*f*) including corresponding image data (any one of image data PD2_*a* to PD2_*f*) are successively output to the respective data line drive units 4*a* to 4*f*. In this way, the first correction is carried out in the timing control unit 5.

As shown in FIG. 7A, the length of the longest first correction time CT1*f* of the first correction times for the respective data line drive units 4*a* to 4*f* is greater than the length of a blank period BR In the first correction by the timing control unit 5, the data line signal 4S to be output from any of the data line drive units 4 can be delayed by a time having the length exceeding that of the blank period from the start time of the horizontal period in a data line drive unit being proximate to the scanning line drive unit 3*a* or the scanning line drive unit 3*b*, for example.

[Example of Second Correction]

Figure 7B:
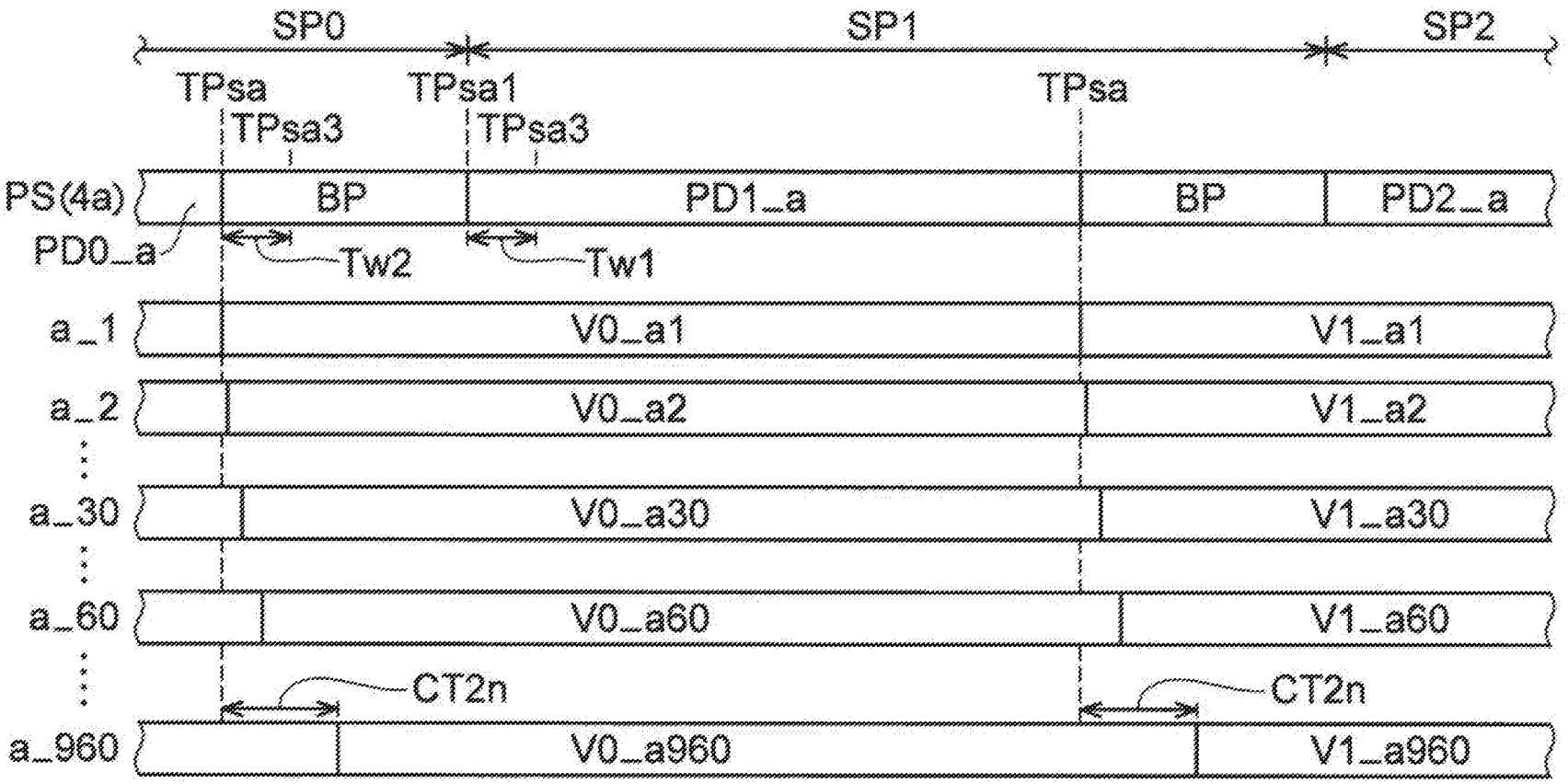
FIG. 7B shows one example of the output timing of a data line signal from one data line drive unit to each data line according to one embodiment of the present disclosure.

FIG. 7B shows one example of the output timing of a data line signal to be output to each data line from one data line drive unit of the display apparatus according to the present embodiment, FIG. 7B shows a second correction by the data line drive unit 4*a* of the display apparatus 1 in FIG. 1 as one example. In FIG. 7B, the same symbol or letter as in FIG. 7A indicates a period, a signal or data being the same as the period, the signal, or the data shown in FIG. 7A. In FIG. 7B, "a_i" (i is an integer) indicates a data line signal to be output to a data line Di of the target data lines D1 to Dn. of the data line drive unit 4*a*. Moreover, V0_*ai* indicates the level (potential) of the data line signal to be output to the data line Di based on an image signal PD0_*a* being transmitted in the horizontal period SP0, V1_*ai* indicates the level (potential) of the data line signal to be output to the data line Di based on the image signal PD1_*a* being transmitted in the horizontal period SP1.

In the example in FIG. 7B, 960 data lines are connected to the data line drive unit 4*a*. In FIG. 7B, at the start time of the blank period BP of each of the horizontal periods SP0, SP1, outputting of a data line signal having the level in the relevant horizontal period. SP0, SP1 (the level of the data line signal to be output based on an image signal being transmitted in the relevant horizontal period SP0, SP1) is started. In other words, in the example in FIG. 7B, each output reference time described previously is the second time point being the start time of the blank period BP.

At an output reference time TPsa in the horizontal period SP0 (a second time point being the start time of the blank period BP in the horizontal period SP0), a data line signal a_1 having a level V0_a1 in the horizontal period SP0 is output to the data line D1 of the data line drive unit 4*a*. In other words, the second correction time for the data line D1 is zero. A data line signal a_2 having a level V0_a2 in the horizontal period SP0 is output with a slight delay by the second correction time for the data line D2 from the output reference time TPsa. Thereafter, data line signals, for example, data line signals a_30 and a_60 each having the level in the horizontal period SP0 are output, in order, to corresponding respective data lines at a time being delayed from the output reference time TPsa by the second correction time for respective data lines. Then, a data line signal a_960 having a level V0_a960 in the horizontal period SP0 is output to the data line Dn after elapsing of a second correction time CT2*n* for the data line Dn from the output reference time TPsa. In the horizontal period SP1 as well, in the same manner as in the horizontal period SP0, data line signals a1 to a960 having respective levels V1_a1 to V1_a960 in the horizontal period SP1 are output to respective data lines with a delay by the second correction time from the output reference time TPsa in the horizontal period SP1. In this way, the second correction is carried out in each data line drive unit 4.

As shown in FIG. 7B, the length of the longest second correction time CT2*n* of the second correction times for the respective data lines is less than the length of the blank period BP. In this way, according to the present embodiment, the length of the second correction time for each data line is less than the length of the blank period BP.

While the second correction time CT2 (see FIG. 4B) can be set for each of the data lines D1 to Dn in the second correction, the data lines D1 to Dn can be divided into a predetermined number of groups for each predetermined number of data lines and one second correction time CT2 can be set for each group, as described below. In other words, data line signals with delays by mutually the same delay amounts (the correction time CT2) can be output to the data lines D in one group. In that case, the number of data lines belonging to each group can be mutually the same or different between groups.

Unlike the example in FIG. 7B, the output reference time can be a start time point of the display period as described previously, or, in other words, a first time point TPsa1 being the end time point of the blank period BP. Alternatively, the output reference time can be a third time point TPsa3 after elapsing of a predetermined time Tw1 or a predetermined time Tw2 from the first time point TPsa1 or a second time point (the output reference time TPsa in the example in FIG. 7B).

[Example of Total Correction (First Correction+Second Correction)]

Figure 7C:
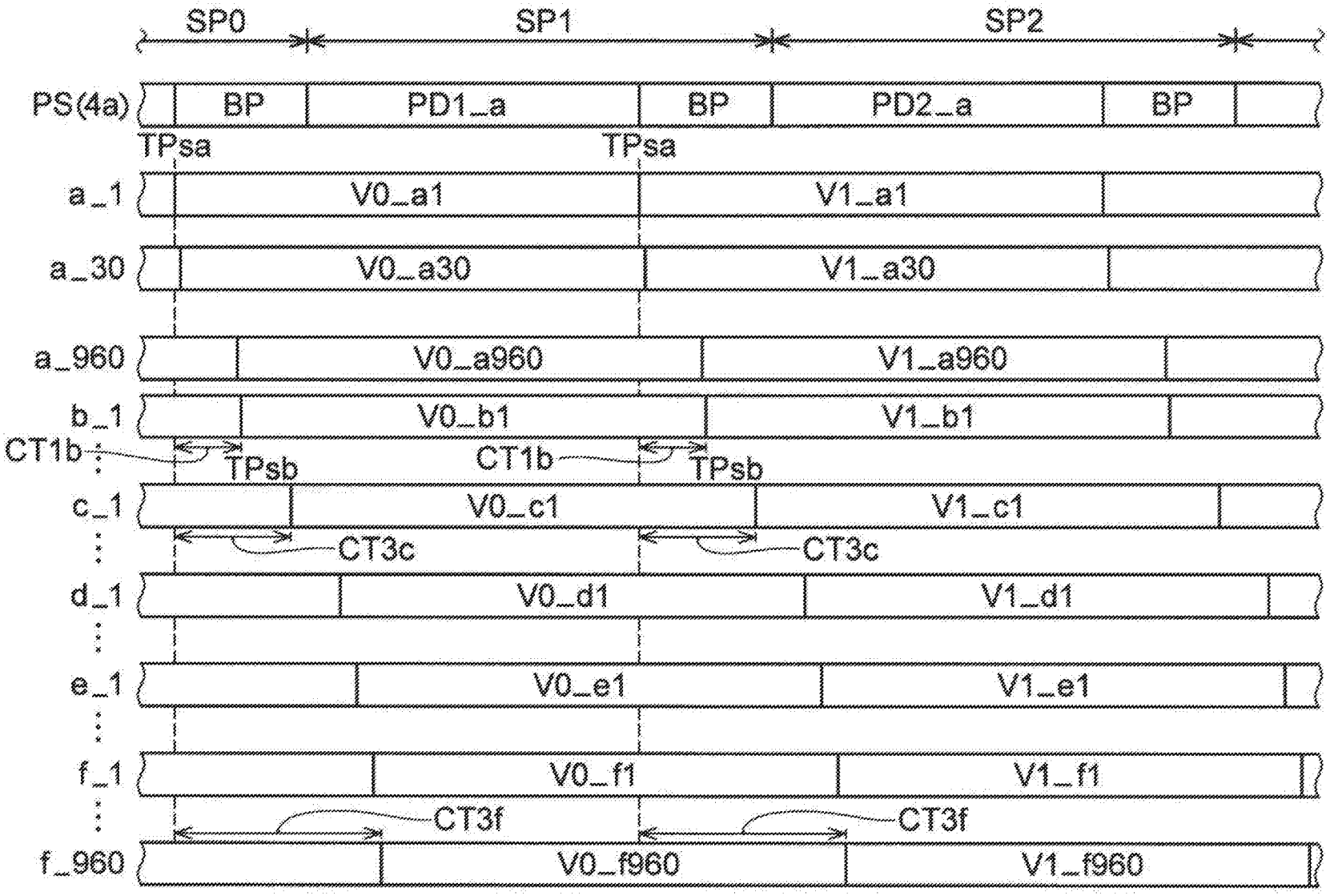
FIG. 7C shows one example of the output timing of the data line signal from a plurality of data line drive units to each data line according to one embodiment of the present disclosure.

FIG. 7C shows one example of the output timing of the data line signal to be output to each data line from each one of a plurality of data line drive units in the display apparatus according to one embodiment. FIG. 7C generally consists of combined FIGS. 7A and 7B. Moreover, in the example in FIG. 7C, the first correction and the second correction are carried out using the first correction time CT1 and the second correction time CT2, respectively, as shown in FIGS. 4A and 4B. In FIG. 7C, the same symbol or letter as in FIGS. 7A and 7B indicates a period, a signal, data, or a level being the same as the period, the signal, the data, or the level shown in FIGS. 7A and 7B. In FIG. 7C, each of "b_1" to "f_1" indicates data line signal to be output to the data line D1 of the target data lines of each of the data line drive units 4*b* to 4*f*. Moreover, "f_960" indicates a data line signal to be output to the data line Dn of the target data lines of the data line drive unit 4*f*. In the same manner as in FIG. 7B, in the example in FIG. 7C, 960 data lines are connected to each of the data line drive units 4*a* to 4*f*. Outputting of the data line signal a_i (i is an integer) from the data line drive unit 4*a* is the same as in FIG. 7B, so that explanation thereof will be omitted.

The image signal PS is transmitted from the timing control unit 5 to the data line drive unit 4*b* with a delay, from transmission of the image signal PS to the data line drive unit 4*a*, by the time difference in the correction time CT1 (see FIG. 4) between the data line drive unit 4*a* and the data line drive unit 4*b*. The first correction time CT1 for the data line drive unit 4*a* is zero in FIGS. 7A and 7C is zero, so that the image signal PS corresponding to each horizontal period is input to the data line drive unit 4*h* with a delay from the data line drive unit 4*a* by the first correction time CT1*b* for the data line drive unit 4*b*. Thus, the data line drive unit 4*b* outputs a data line signal b_1 having a level V0_b1, V1_b1 in each horizontal period SP0, SP1 from the output reference time TPsb being delayed by the first correction time CT1*b* from the output reference time TPsa of the data line drive unit 4*a*. In the data line drive units 4*b*, 4*d* and 4*f*, the second correction time CT2 for the data line D1 of data lines of each data line drive unit 4 is zero (see FIG. 4B). While not shown, a data line signal is also output to a data line other than the data line D1 of the target data lines for the data line drive unit 4*b* with a delay by the second correction time CT2 for each data line.

In the data line drive unit 4*c*, the second correction time CT2 for the data line D1 of the target data lines of the data line drive unit 4*c* is greater than zero (see CT3*c* in FIG. 4B). Thus, a data line signal c_1 having a level V0_c1, V1_c1 in each horizontal period SP0, SP1 is output with a delay from the output reference time TPsa of the data line drive unit 4*a* by a total correction time CT3*c* being the sum of the first correction time CT1 for the data line drive unit 4*c* and the second correction time CT2 (>0) for the data line D1.

While the first correction time CT1 for each of the data line drive unit 4*d* and the data line drive unit 4*e* is the same (see FIG. 4A), with respect to the second correction time CT2, the data line D1 of the data line drive unit 4*e* is longer than the data line D1 of the data line drive unit 4*d* (see FIG. 4B). Thus, a data line signal e_1 having a level in each horizontal period SP0, SP1 is output with a delay from a data line signal d_1 having a level V0_d1, V1_d1 of each horizontal period SP0, SP1. While not shown, data line signals with a delay from the output reference point TPsa of the data line drive unit 4*a* by the first correction and the second correction are respectively output also to the respective data lines other than the data line D1 of the target data lines of the data line drive units 4*c* to 4*e*.

Data line signals f_1 to f_960 with a delay from the output reference time TPsa of the data line drive unit 4*a* by the first correction and the second correction are output to the data lines D1 to Dn also in the data line drive unit 4*f*. In the example in FIG. 7C, the lengths of several total correction times are greater than the length of the blank period BP as that of a total correction time CT3*f* for the data line Dn of the data line drive unit 4*f*, In this way, according to the present embodiment, the data line signal 4S to be output to each data line D can be delayed in a wide range and, even more, in minute increase/decrease steps.

While not shown in FIGS. 7A to 7C, in the data line drive units 4*g* to 4*m* (except for 4*l*) as well, outputting of the data line signal to be output to each data line is similarly delayed. In principle, the total correction time is brought to be longer toward the data line D1 of the data line drive unit 4*g* from the data line Dn of the data line drive unit 4*m*.

[Other Examples of Correction Time]

Figure 8A:
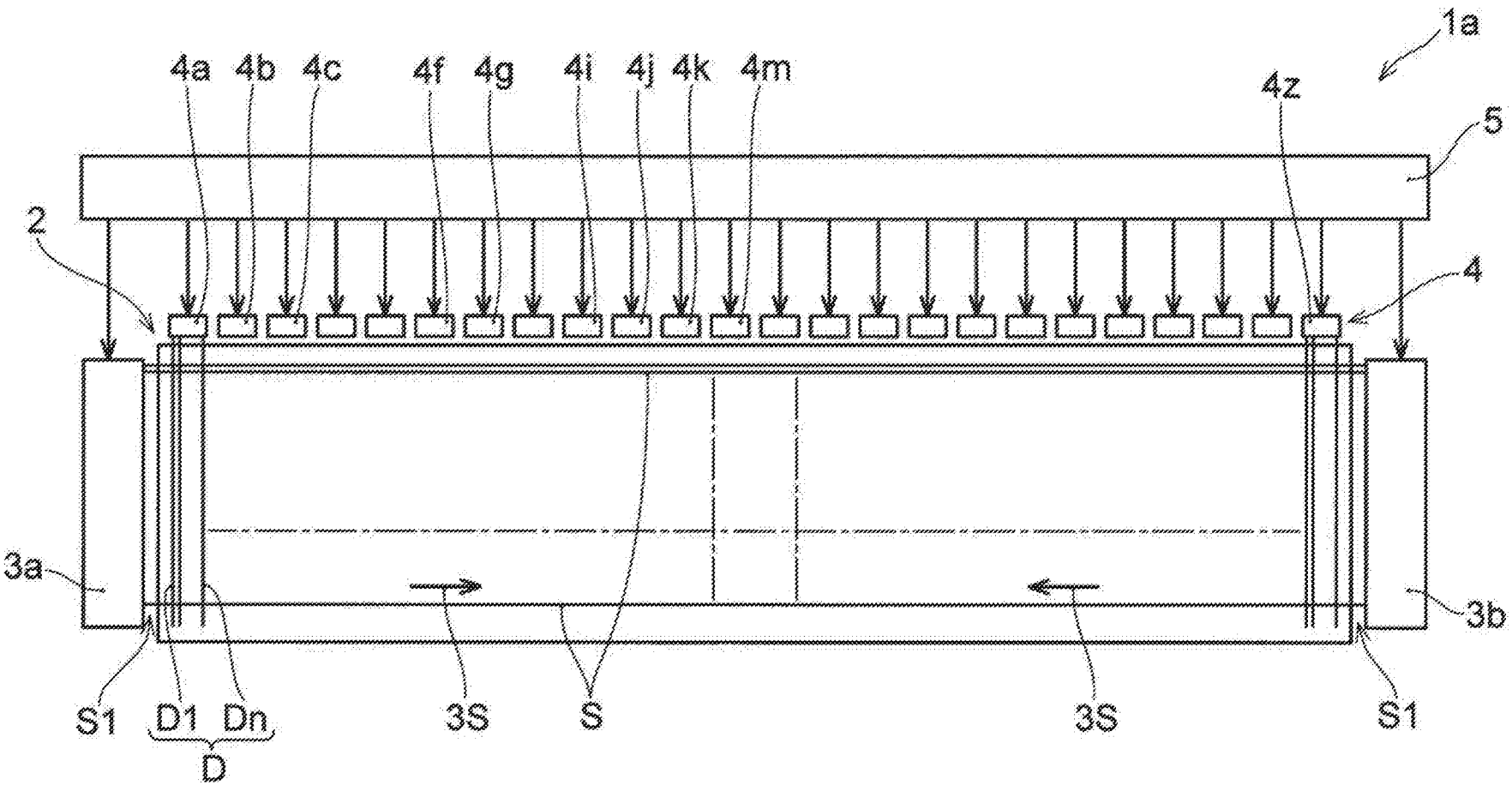
FIG. 8A schematically shows another example of the configuration of the display apparatus according to one embodiment of the present disclosure.
Figure 8B:
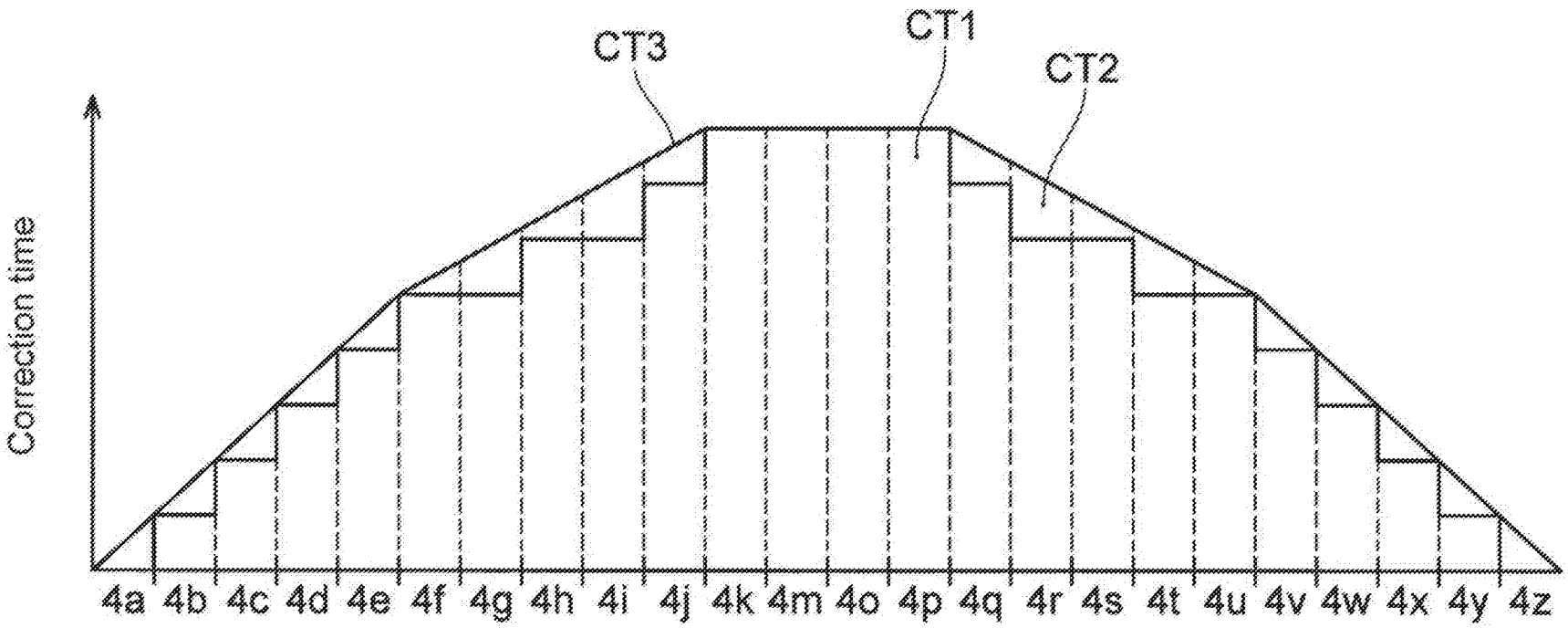
FIG. 8B shows another example of the correction time in the timing control unit and the data line drive unit according to one embodiment of the present disclosure.
Figure 8C:
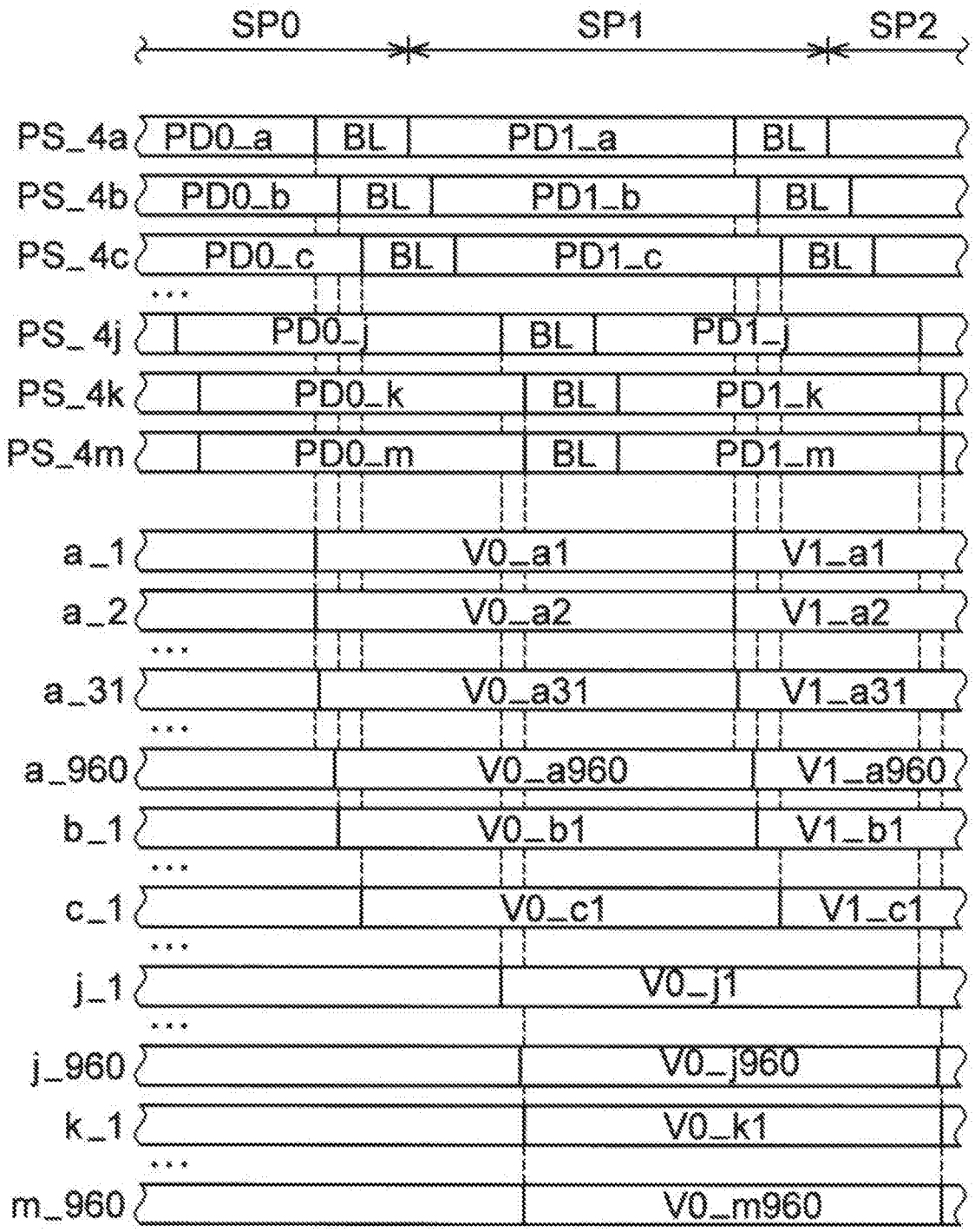
FIG. 8C shows another example of the input timing of the image signal into the plurality of data line drive units and the output timing of the data line signal to each data line according to one embodiment of the present disclosure.

With reference to FIGS. 8A to 8C, other examples of the correction time according to the display apparatus of the present embodiment is described. FIG. 8A schematically shows the configuration of the display apparatus 1*a* being another example according to the present embodiment. The configuration of the display apparatus 1*a* shown in FIG. 8A is different from that of the display apparatus 1 in the example in FIG. 1 in comprising 24 data line drive units 4 being data line drive units 4*a* to 4*z* (except for 4*l* and 4*n*). Except for the number of data line drive units 4, the display apparatus 1*a* has the same structure as the display apparatus 1 in FIG. 1. Therefore, explanations on the structure and the constituting elements of the display apparatus 1*a* will be omitted.

FIG. 8B shows one example of correction times in the timing control unit 5 and the data line drive units 4*a* to 4*z* in the example inn FIG. 8A. In the same way as FIG. 4B, FIG. 8B shows the first correction time CT1, the second correction time CT2, and the total correction time CT3. "4*a*" to "4*z*" being lined up on the horizontal axis in FIG. 8B represent respective data line drive units. The horizontal axis of FIG. 8B, in the same manner as that of FIG. 4B, shows the position in the row direction along the scanning line S on the display panel 2.

In the example in FIG. 8B, a group of data line signals to be output to the target data lines of the data line drive unit 4*a* is corrected by only a second correction using the second correction time CT2 by the data line drive unit 4*a* without being subjected to a first correction by the timing control unit 5. Moreover, each group of data line signals to be output to the target data lines of each of the data line drive units 4*b* to 4*f* includes both a data line signal (for example, a data line signal to be output to a data line being proximate to the scanning line drive unit 3*a* in FIG. 8A) to be subjected to only a first correction and a data line signal to be subjected to both the first correction and the second correction. Moreover, in each group of data line signals to be output to the target data lines of each of the data line drive units 4*g* to 4*i*, all data line signals are corrected by both the first correction and the second correction. On the other hand, in the example in FIG. 8B, each group of data line signals to be output to the target data lines of each of the data line drive units 4*k* and 4*m* is subjected to only the first correction, being not subjected to the second correction.

In this way, a breakdown of the total correction time CT3 can be arbitrarily allocated to the first correction time CT1 and the second correction time CT2. However, in a case that each data line drive unit 4 comprises only two storage means being capable of storing image data in one horizontal period (for example, the previously-described first and second image data storage circuits 45, 44), the length of the second correction time CT2 is preferably brought to be less than that of the blank period.

Moreover, in a case that the display apparatus 1*a* and the display apparatus 1 in the example in FIG. 1) comprises the scanning line drive unit 3*a* or the scanning line drive unit 3*b* at only one end of the display panel 2 in the row direction, the first correction time CT1, the second correction time CT2, and the total correction time CT3 being shown in the same method as in FIG. 8B can have a shape not having both an upward-to-the right portion and an upward-to-the left portion. Furthermore, even in a case that the display apparatus 1*a* and the display apparatus 1 in the example in FIG. 1) has the scanning line drive units 3*a* and 3*b* at the opposite ends of the display panel 2 in the row direction in the same manner as in FIG. 8A, the first correction time CT1 and the total correction time CT3 being shown in the same method as in FIG. 8B can be asymmetrical in the left and right. In other words, when the delay property of the scanning line signal 3S in the display panel 2 is asymmetrical in the left and right on the display panel 2, each correction time can be set in accordance with the delay property of the scanning line signal 3S.

FIG. 8C shows one example of the input timing of the image signal into the plurality of data line drive units 4*a* to 4*m* and the output timing of the data line signal to each data line D in the example in FIG. 8A. The output timing of the data line signal shown in FIG. 8C is corrected by the first and second corrections using the correction times shown in FIG. 8B. Each image signal and each data line signal shown in FIG. 8C is shown with the same method as in FIG. 70, In FIG. 8C, the same symbol or letter as in FIG. 7C indicates a period, a signal, data, or a level being the same as the period, the signal, the data, or the level shown in FIG. 7C. In FIG. 80, PS_4*a* to PS_4*c* and PS_4*j* to PS_4*m* (except for PS_4*l*) indicate respective image signals to be input to the respective data line drive units 4*a* to 4*c* and the data line drive units 4*j* to 4*m*. In FIG. 8C, "j_1" and "k_1" indicate the data line signals to be output to the data line D1 of the target data lines of the data line drive unit 4*j* and the data line drive unit 4*k*, respectively. Moreover, "j_960" and "m_960" indicate the data line signals to be output to the data line Dn of the target data lines of the data line drive unit 4*j* and the data line drive unit 4*m*, respectively. In the same manner as in FIG. C, in the example in FIG. 8C, 960 target data lines are connected to each of the data line drive units 4*a* to 4*z*.

As shown in FIG. 8C, a first correction is carried out in the timing control unit 5, so that in each horizontal period SP0, SP1, pixel signals PS_4*a* to PS_4*m* including corresponding image data sets image data PD0_*a* to PD0_*m* in the horizontal period SP0, image data PD1_*a* to PD1_*m* in the horizontal period SP1) are input to each of the data line drive units 4*a* to 4*m* at mutually different timings. Then, a second correction is carried out using the second correction time in the each of the data line drive units 4*a* to 4*m* and data line signals are input to the respective data lines D.

While details are not shown in FIG. 8B, in the example in FIG. 8C, a set of 960 data lines being connected to the data line drive unit 4*a* is divided into groups, each having 30 data lines, and the second correction time is set for each group. Thus, as shown in FIG. 8C, between a data line signal a_1 and a data line signal a_2, the signal levels are switched from levels V0_a1 and V0_a2 in the horizontal period SP0 to levels V1_a1 and V1_a2 in the horizontal period SP1 at the same timing. Then, in a data line signal a_31, the timing of switching to a level V1_a31 in the horizontal period SP1 is slightly delayed from the switching timing to the level V1_a1 in the data line signal a_1. This delay time is a second correction time for the data line to which the data line signal a_31 is output. In the example in FIG. 8C, outputting of each data line signal having the level in each horizontal period is delayed for each group of the data lines by the second correction time being set for each group in this way. The second correction time for each group can be further increased for a group of data lines being more distant from the scanning line drive unit (the scanning line drive unit being nearer to each group of the two scanning line drive units 3*a*, 3*b* in the example in FIG. 8A).

In the example in FIG. 8C, the total correction time is further increased for a data line signal b_1 and a data line signal c_1. In this way, the total correction time is increased up to a data line signal j_960. Then, as can be understood from FIG. 8B, only the first correction is carried out for data line signals k_1 to m_960, and the delay amount is not increased/decreased for the data line signals k_1 to m_960. For example, when the scanning line signal 3S propagates at least a certain distance on the scanning line S, an effect on the selection period of each pixel due to deforming of the waveform in conjunction with the further propagation can become so small as to be negligible. Therefore, the correction time (the total correction time) for a set of data lines being distant from a scanning line drive unit (a scanning line drive unit being nearer to each group of the two scanning line drive units 3*a* and 3*b* in the example inn FIG. 8A), for example, a set of data lines being separated by at least 640 mm from the one end S1 to which a scanning signal is input, can be set to be constant.

Another Embodiment

Figure 9:
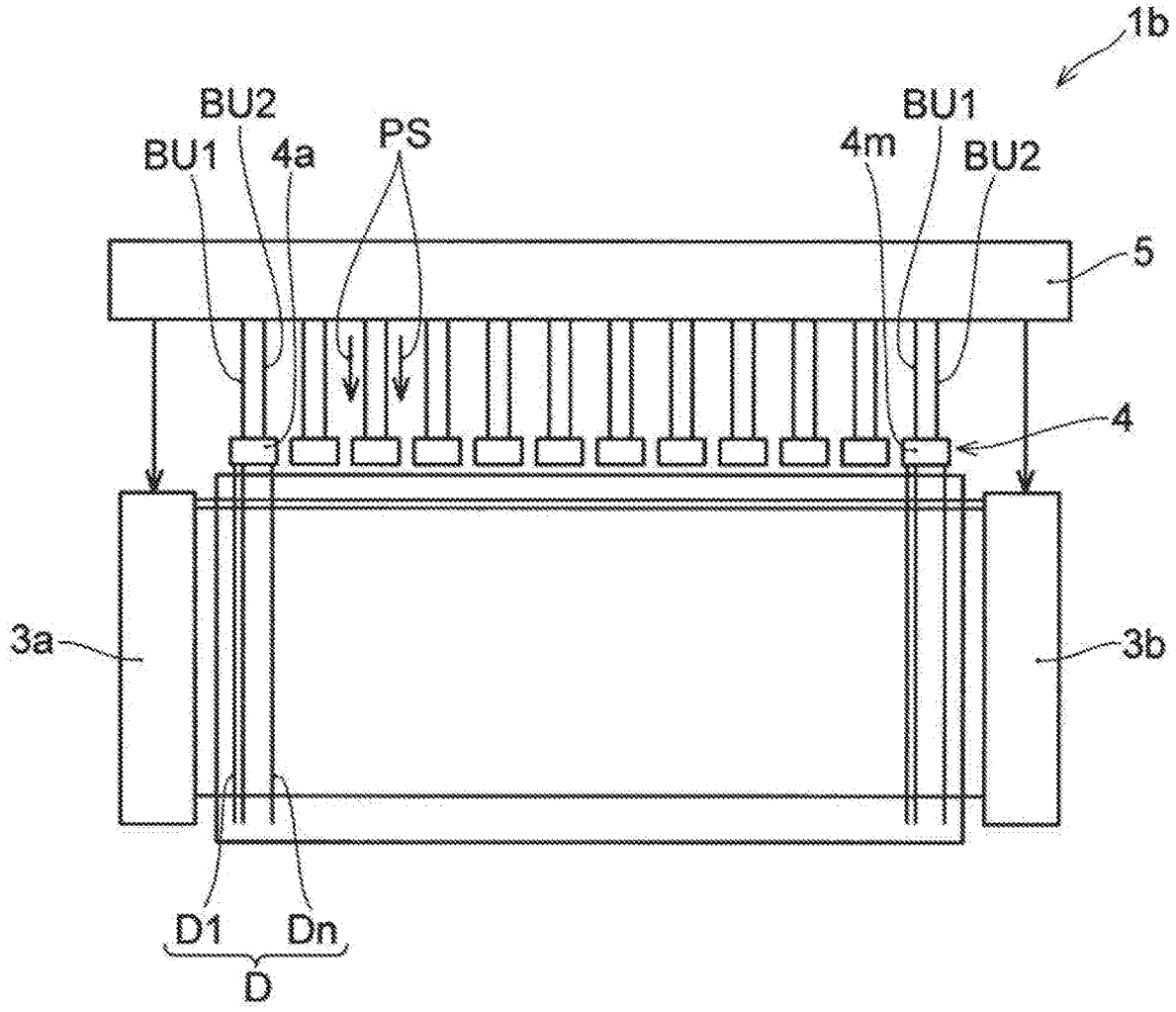
FIG. 9 schematically shows one example of the configuration of the display apparatus according to another embodiment of the present disclosure.

FIG. 9 schematically shows one example of the configuration of the display apparatus 1*b* according to another embodiment of the present disclosure. In a display apparatus 1*b* according to the present embodiment, each of data line drive units 4*a* to 4*m* (except for 4*l*) being connected to a timing control unit 5 by two buses BU1 and BU2 is different from the display apparatus 1 according to one embodiment shown in FIG. 1. The display apparatus 1*b* according to the present embodiment and the display apparatus 1 in FIG. 1 have the same structure and the constituting elements except for the above-described point, so that explanations on the constituting elements in the display apparatus 1*b* being the same as those in the display apparatus 1*b* will be omitted.

According to the present embodiment, the image signal PS is transmitted to each of the data line drive units 4*a* to 4*m* from the timing control unit 5 through each of the two buses BU1 and BU2. The two buses BU1 and BU2 are used for transmission of the image signal PS for mutually different data lines D (for example, an even-numbered column data line and an odd-numbered column data line). In this way, a so-called dual lane scheme comprising the two buses BU1 and BU2 can be used to halve the transmission rate required for transmission of the image signal PS, making it possible to easily and suitably transmit the image signal. PS.

According to the present embodiment as well, in the same manner as in the one embodiment in FIG. 1, the output timing of the data line signal in each horizontal period is varied for each data line D by the second correction in each of the data line drive units 4*a* to 4*m*. However, the phases of the image signals PS propagating through the two buses BU1 and BU2 are preferably the same. Moreover, in a case that, in transmission through each of the two buses, a clock embedded scheme is used in which a transmission clock is embedded in a data signal to be transmitted, transmission clocks to be embedded in each of the image signals PS transmitting through each bus preferably share an original oscillation circuit. In this way, complexification of the reception circuit in each of the data line drive units 4 can be avoided. Moreover, as described previously, in a case that the transmission clock is used in the first clock signal CK1 (see FIG. 5) and/or the second clock signal CK2 (see FIG. 6), an accurate correction as intended as described previously can be carried out.

SUMMARY (1) A display apparatus according to one embodiment of the present disclosure comprises: a display panel comprising a plurality of pixels being arranged in a matrix, a plurality of scanning lines being connected to a group of pixels being lined up in a row direction of the plurality of pixels, and a plurality of data lines being connected to a group of pixels being lined up in a column direction of the plurality of pixels; a scanning line drive unit to successively output a scanning line signal to the plurality of scanning lines, the scanning line signal to select the group of pixels being lined up in the row direction; a plurality of data line drive units, each being connected to two or more target data lines of the plurality of data lines, to output a data line signal to each of the two or more target data lines, wherein the data line signal supplies a desired voltage to two or more target pixels of a group of pixels being selected by the scanning line signal, the two or more target pixels being connected to the two or more target data lines; and a timing control unit to transmit an image signal to each one of the plurality of data line drive units and to control the operational timing of the scanning line drive unit and the plurality of data line drive units, the image signal being a signal to be the basis of the data line signal and comprising information on luminance that each pixel is to have, wherein a first correction time is set individually for each one of the plurality of data line drive units, the first correction time indicating a delay amount when the image signal is transmitted; a second correction time is set individually for each of the two or more target data lines, the second correction time indicating a delay amount when the data line signal is output; the timing control unit transmits the image signal to each one of the plurality of data line drive units for each group of pixels being lined up in the row direction, while delaying the image signal by the first correction time being set for a relevant data line drive unit from a start time of transmission with respect to a relevant group of pixels being lined up in the row direction based on a first clock signal; and each one of the plurality of data line drive units outputs the data line signal to each of the two or more target data lines, while delaying the data line signal by the second correction time being set for a relevant target data line from an output reference time with respect to the two or more target pixels based on a second clock signal being synchronized with the first clock signal.

The configuration in (1) makes it possible to accurately reduce display non-uniformity due to a propagation delay of a scanning line signal in a display apparatus with respect to a wide range of delays while suppressing complexification of the structure and an increase in manufacturing cost.

(2) In the display apparatus according to an aspect of (1) inn the above, the output reference time with respect to the two or more target pixels can be a first time point at which the data line drive unit starts to receive the image signal with respect to the two or more target pixels, a second time point at which the data line drive unit completes reception of the image signal with respect to the two or more target pixels, or a third time point at which a predetermined time has elapsed after the first time point or the second time point. This aspect makes it possible to output the data line signal, in each data line drive unit, to the target data lines at the timing based on the reception timing of the image signal.

(3) In the display apparatus according to an aspect in (1) or (2) in the above, for one group of pixels being lined up in the row direction, the time difference between a time point at which the data line signal is output to one data line of the plurality of data lines and a time point at which the data line signal is output to other one of data lines of the plurality of data lines can be equal to the difference between the sum of the first correction time being set for the data line drive unit to which the one data line is connected and the second correction time being set for the one data line, and the sum of the first correction time being set for the data line drive unit to which the other one of data lines is connected and the second correction time being set for the other one of data lines. This aspect may make it possible to more effectively suppress display non-uniformity.

(4) In the display apparatus according to an aspect of any one of (1) to (3) in the above, the plurality of data line drive units can be arrayed along the row direction of the display panel; the scanning line drive unit can be is arranged at an end of the display panel in the row direction; with respect to a first data line drive unit and a second data line drive unit neighboring each other in the plurality of data line drive units, the first correction time being set for the second data line drive unit being arranged farther than the first data line drive unit from the end at which the scanning line drive unit is being arranged can be equal to or greater than the first correction time being set for the first data line drive unit; and, with respect to a first target data line and a second target data line of the two or more target data lines, the first target data line and the second target data line neighboring each other, the second correction time being set for the second target data line being arranged farther than the first target data line from the end at which the scanning line drive unit is being arranged can be equal to or greater than the second correction time being set for the first target data line. This aspect makes it possible to supply a desired voltage to each pixel at the appropriate timing according to the propagation delay of the scanning line signal.

(5) In the display apparatus according to an aspect of any one of (1) to (4) in the above, the output reference time with respect to the two or more target pixels can be a time point at which the data line drive unit completes reception of the image signal with respect to the two or more target pixels; after completing the reception of the image signal with respect to the two or more target pixels, the data line drive unit can receive the following image signal after elapsing of a predetermined blank period; and a maximum value of the second correction time can be shorter than the blank period. This aspect makes it possible to suitably capture image data in each horizontal period in the data line drive unit.

(6) In the display apparatus according to an aspect of any one of (1) to (5) in the above, the timing control unit can comprise: a first timing generating circuit to generate a first timing signal based on the first correction time being set for each one of the plurality of data line drive units and the first clock signal; and an image signal storage circuit to latch and output the image signal for each one of the plurality of data line drive units based on the first timing signal. This aspect makes it possible to easily carry out delaying of the image signal in the timing control unit.

(7) In the display apparatus according to an aspect of any one of (1) to (6) in the above, each one of the plurality of data line drive units can comprise: a second timing generating circuit to generate a second timing signal based on the second correction time being set for each of the two or more target data lines and the second clock signal; and a first image data storage circuit to latch and output image data for each of the two or more target pixels being extracted from the image signal with respect to the two or more target pixels, based on the second timing signal. This aspect makes it possible to easily carry out delaying of the data line signal in the data line drive unit.

(8) In the display apparatus according to an aspect of (7) in the above, each one of the plurality of data line drive units can further comprise a second image data storage circuit to store the image data for each of the two or more target pixels. This aspect makes it possible to easily carry out delaying of the data line signal in the data line drive unit.

(9) In the display apparatus according to an aspect of any one of (1) to (8) in the above, the first clock signal and the second clock signal can be clock signals sharing an original oscillation circuit, or clock signals generated by multiplying and/or dividing clock signals sharing an original oscillation circuit. This aspect makes it possible to more accurately carry out a correction using the first correction time and the second correction time.

(10) In the display apparatus according to an aspect of any one of (1) to (9) in the above, the first clock signal and the second clock signal can be clock signals sharing an SSCG (Spread Spectrum Clock Generator), or clock signals generated by multiplying and/or dividing clock signals sharing an SSCG. This aspect makes it possible to more accurately carry out a correction using the first correction time and the second correction time while reducing EMI.

The invention claimed is:

1. A display apparatus comprising:

a display panel comprising a plurality of pixels being arranged in a matrix, a plurality of scanning lines being connected to a group of pixels being lined up in a row direction of the plurality of pixels, and a plurality of data lines being connected to a group of pixels being lined up in a column direction of the plurality of pixels;

a scanning line drive unit to successively output a scanning line signal to the plurality of scanning lines, the scanning line signal to select the group of pixels being lined up in the row direction;

a plurality of data line drive units, each being connected to two or more target data lines of the plurality of data lines, to output a data line signal to each of the two or more target data lines, wherein the data line signal supplies a desired voltage to two or more target pixels of a group of pixels being selected by the scanning line signal, the two or more target pixels being connected to the two or more target data lines; and a timing control unit to transmit an image signal to each one of the plurality of data line drive units and to control the operational timing of the scanning line drive unit and the plurality of data line drive units, the image signal being a signal to be a basis of the data line signal and comprising information on luminance that each pixel is to have, wherein a first correction time is set individually for each one of the plurality of data line drive units, the first correction time indicating a delay amount when the image signal is transmitted;

a second correction time is set individually for each of the two or more target data lines, the second correction time indicating a delay amount when the data line signal is output;

the timing control unit transmits the image signal to each one of the plurality of data line drive units for each group of pixels being lined up in the row direction, while delaying the image signal by the first correction time being set for a relevant data line drive unit from a start time of transmission with respect to a relevant group of pixels being lined up in the row direction based on a first clock signal;

each one of the plurality of data line drive units outputs the data line signal to each of the two or more target data lines, while delaying the data line signal by the second correction time being set for a relevant target data line from an output reference time with respect to the two or more target pixels based on a second clock signal being synchronized with the first clock signal; and for one group of pixels being lined up in the row direction, a time difference between a time point at which the data line signal is output to one data line of the plurality of data lines and a time point at which the data line signal is output to another one of respective data lines of the plurality of data lines is equal to a difference between a sum of the first correction time being set for the data line drive unit to which the one data line is connected and the second correction time being set for the one data line, and a sum of the first correction time being set for the data line drive unit to which the another one of the respective data lines is connected and the second correction time being set for the another one of the respective data lines.

2. The display apparatus according to claim 1, wherein the output reference time with respect to the two or more target pixels is a first time point at which the data line drive unit starts to receive the image signal with respect to the two or more target pixels, a second time point at which the data line drive unit completes reception of the image signal with respect to the two or more target pixels, or a third time point at which a predetermined time has elapsed after the first time point or the second time point.

3. The display apparatus according to claim 1, wherein the plurality of data line drive units is arrayed along the row direction of the display panel;

the scanning line drive unit is arranged at an end of the display panel in the row direction;

with respect to a first data line drive unit and a second data line drive unit neighboring each other in the plurality of data line drive units, the first correction time being set for the second data line drive unit being arranged farther than the first data line drive unit from the end at which the scanning line drive unit is being arranged is equal to or greater than the first correction time being set for the first data line drive unit; and with respect to a first target data line and a second target data line of the two or more target data lines, the first target data line and the second target data line neighboring each other, the second correction time being set for the second target data line being arranged farther than the first target data line from the end at which the scanning line drive unit is being arranged is equal to or greater than the second correction time being set for the first target data line.

4. The display apparatus according to claim 1, wherein the timing control unit comprises:

a first timing generating circuit to generate a first timing signal based on the first correction time being set for each one of the plurality of data line drive units and the first clock signal; and an image signal storage circuit to latch and output the image signal for each one of the plurality of data line drive units based on the first timing signal.

5. The display apparatus according to claim 1, wherein each one of the plurality of data line drive units comprises:

a second timing generating circuit to generate a second timing signal based on the second correction time being set for each of the two or more target data lines and the second clock signal; and a first image data storage circuit to latch and output image data for each of the two or more target pixels being extracted from the image signal with respect to the two or more target pixels, based on the second timing signal.

6. The display apparatus according to claim 5, wherein each one of the plurality of data line drive units further comprises a second image data storage circuit to store the image data for each of the two or more target pixels.

7. The display apparatus according to claim 1, wherein the first clock signal and the second clock signal are clock signals sharing an original oscillation circuit, or clock signals generated by multiplying and/or dividing clock signals sharing an original oscillation circuit.

8. The display apparatus according to claim 1, wherein the first clock signal and the second clock signal are clock signals sharing an SSCG (Spread Spectrum Clock Generator), or clock signals generated by multiplying and/or dividing clock signals sharing an SSCG.

9. A display apparatus comprising:

a display panel comprising a plurality of pixels being arranged in a matrix, a plurality of scanning lines being connected to a group of pixels being lined up in a row direction of the plurality of pixels, and a plurality of data lines being connected to a group of pixels being lined up in a column direction of the plurality of pixels;

a scanning line drive unit to successively output a scanning line signal to the plurality of scanning lines, the scanning line signal to select the group of pixels being lined up in the row direction;

a plurality of data line drive units, each being connected to two or more target data lines of the plurality of data lines, to output a data line signal to each of the two or more target data lines, wherein the data line signal supplies a desired voltage to two or more target pixels of a group of pixels being selected by the scanning line signal, the two or more target pixels being connected to the two or more target data lines; and a timing control unit to transmit an image signal to each one of the plurality of data line drive units and to control the operational timing of the scanning line drive unit and the plurality of data line drive units, the image signal being a signal to be a basis of the data line signal and comprising information on luminance that each pixel is to have, wherein a first correction time is set individually for each one of the plurality of data line drive units, the first correction time indicating a delay amount when the image signal is transmitted;

a second correction time is set individually for each of the two or more target data lines, the second correction time indicating a delay amount when the data line signal is output;

the timing control unit transmits the image signal to each one of the plurality of data line drive units for each group of pixels being lined up in the row direction, while delaying the image signal by the first correction time being set for a relevant data line drive unit from a start time of transmission with respect to a relevant group of pixels being lined up in the row direction based on a first clock signal;

each one of the plurality of data line drive units outputs the data line signal to each of the two or more target data lines, while delaying the data line signal by the second correction time being set for a relevant target data line from an output reference time with respect to the two or more target pixels based on a second clock signal being synchronized with the first clock signal;

the output reference time with respect to the two or more target pixels is a time point at which the data line drive unit completes reception of the image signal with respect to the two or more target pixels;

after completing the reception of the image signal with respect to the two or more target pixels, the data line drive unit receives the following image signal after elapsing of a predetermined blank period; and a maximum value of the second correction time is shorter than the blank period.

10. The display apparatus according to claim 9, wherein the plurality of data line drive units is arrayed along the row direction of the display panel;

the scanning line drive unit is arranged at an end of the display panel in the row direction;

with respect to a first data line drive unit and a second data line drive unit neighboring each other in the plurality of data line drive units, the first correction time being set for the second data line drive unit being arranged farther than the first data line drive unit from the end at which the scanning line drive unit is being arranged is equal to or greater than the first correction time being set for the first data line drive unit; and with respect to a first target data line and a second target data line of the two or more target data lines, the first target data line and the second target data line neighboring each other, the second correction time being set for the second target data line being arranged farther than the first target data line from the end at which the scanning line drive unit is being arranged is equal to or greater than the second correction time being set for the first target data line.

11. The display apparatus according to claim 9, wherein the timing control unit comprises:

a first timing generating circuit to generate a first timing signal based on the first correction time being set for each one of the plurality of data line drive units and the first clock signal; and an image signal storage circuit to latch and output the image signal for each one of the plurality of data line drive units based on the first timing signal.

12. The display apparatus according to claim 9, wherein each one of the plurality of data line drive units comprises:

a second timing generating circuit to generate a second timing signal based on the second correction time being set for each of the two or more target data lines and the second clock signal; and a first image data storage circuit to latch and output image data for each of the two or more target pixels being extracted from the image signal with respect to the two or more target pixels, based on the second timing signal.

13. The display apparatus according to claim 12, wherein each one of the plurality of data line drive units further comprises a second image data storage circuit to store the image data for each of the two or more target pixels.

14. The display apparatus according to claim 9, wherein the first clock signal and the second clock signal are clock signals sharing an original oscillation circuit, or clock signals generated by multiplying and/or dividing clock signals sharing an original oscillation circuit.

15. The display apparatus according to claim 9, wherein the first clock signal and the second clock signal are clock signals sharing an SSCG (Spread Spectrum Clock Generator), or clock signals generated by multiplying and/or dividing clock signals sharing an SSCG.

* * * * *